US012753929B2

(12) United States Patent
Yoo

(10) Patent No.: US 12,753,929 B2
(45) Date of Patent: Oct. 6, 2026

(54) APPLIANCE

(71) Applicant: LG ELECTRONICS INC., Seoul (KR)

(72) Inventor: Junhee Yoo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 466 days.

(21) Appl. No.: 18/229,345

(22) Filed: Aug. 2, 2023

(65) Prior Publication Data

US 2024/0044500 A1 Feb. 8, 2024

(30) Foreign Application Priority Data

Aug. 2, 2022 (KR) ..... 10-2022-0096378

(51) Int. Cl.
*F24C 15/00* (2006.01)
*F24C 15/04* (2006.01)

(52) U.S. Cl.
CPC ..... *F24C 15/006* (2013.01); *F24C 15/04* (2013.01)

(58) Field of Classification Search
CPC ..... F24C 15/006; F24C 15/04; F24C 7/085; F24C 15/02; F24C 15/08; F24C 15/322
USPC ..... 126/19 R
See application file for complete search history.

(56) References Cited

U.S. PATENT DOCUMENTS

| | | | |
|---|---|---|---|
| 3,659,578 A | 5/1972 | Davis et al. | |
| 3,889,099 A | 6/1975 | Nuss | |
| 3,924,601 A | 12/1975 | Nuss | |
| 4,601,279 A | 7/1986 | Guerin | |
| 4,865,010 A | 9/1989 | Kett | |
| 8,726,791 B2 | 5/2014 | Adamczak et al. | |
| 9,686,825 B2 | 6/2017 | Underwood et al. | |
| 2010/0206414 A1 | 8/2010 | Adamczak et al. | |
| 2016/0320067 A1 | 11/2016 | Dachs et al. | |
| 2021/0144286 A1* | 5/2021 | Jang | G03B 17/55 |

FOREIGN PATENT DOCUMENTS

| | | | |
|---|---|---|---|
| CA | 2570972 C * | 1/2012 | F04D 29/4226 |
| DE | 8803806 | 5/1988 | |
| FR | 2271515 | 12/1975 | |
| JP | 2018-094416 | 6/2018 | |
| KR | 10-2015-0030016 | 3/2015 | |
| WO | WO 2015/086247 | 6/2015 | |

OTHER PUBLICATIONS

Extended European Search Report dated Dec. 14, 2023 issued in Application No. 23189154.0.
Extended European Search Report dated Dec. 8, 2025 issued in Application No. 25183099.8.

* cited by examiner

*Primary Examiner* — Allen R. B. Schult
*Assistant Examiner* — William C Weinert
(74) *Attorney, Agent, or Firm* — KED & ASSOCIATES, LLP

(57) ABSTRACT

Disclosed herein is a cooking appliance. The cooking appliance includes a cover protrusion coupled to an air guide to fix the air guide to a gap between a door and a control panel, and a position at which the air guide is coupled to the cover protrusion is guided by a guide protrusion portion provided at the cover protrusion.

18 Claims, 14 Drawing Sheets

APPLIANCE

CROSS-REFERENCE TO RELATED APPLICATION(S)

This application claims priority to and the benefit of Korean Patent Application No. 10-2022-0096378, filed in Korea on Aug. 2, 2022, the disclosure of which is incorporated herein by reference in its entirety.

BACKGROUND

1. Field

The present disclosure relates to a cooking appliance, and more particularly, to a cooking appliance having a door provided to open and close a cooking chamber.

2. Background

Cooking appliances, which are a type of home appliance for cooking food, are appliances installed in a kitchen space to cook food according to an intention of a user. Such cooking appliances may be classified in various ways according to the type of heat source used, the shape, the type of fuel, or the like.

When classified according to the type of space where food is placed, cooking appliances may be classified into open-type cooking appliances and closed-type cooking appliances. The closed-type cooking appliances include an oven, a microwave, and the like. Also, the open-type cooking appliances include a cooktop, a hob, a griddle, and the like.

The closed-type cooking appliances are cooking appliances in which a space where food is placed is covered. Such closed-type cooking appliances may heat the covered space to cook food.

A cooking chamber is provided inside a closed-type cooking appliance. The cooking chamber is a space where food is placed and is a space covered when the cooking appliance cooks food. The cooking chamber is a space where food is actually cooked.

A door configured to selectively open or close the cooking chamber is rotatably provided to the closed-type cooking appliance. By a door hinge provided between the door and a main body having the cooking chamber formed therein, the door may be rotatably installed on the main body. The door may rotate about a portion coupled to the main body through the door hinge to selectively open or close the cooking chamber.

A heat source may be provided in an inner space of the cooking chamber opened and closed by the door. The heat source is provided to heat the cooking chamber. A gas burner, an electric burner, or the like may be used as the heat source.

An electric component chamber may be disposed on the cooking chamber. Electric components necessary for operation of the closed-type cooking appliance may be provided in the electric component chamber. The electric component chamber is formed as a space separated from the cooking chamber. A control panel may be disposed above the door and in front of the electric component chamber. There may be a gap/space between the control panel and the door. The gap/space is defined on an upper side by the control panel, on a lower side by the door, on a rear side by the electric component chamber. The gap/space may be open at the front side.

Hot air may be exhausted/leaked from the cooking chamber and/or the electric component chamber towards a front of the cooking appliance—into the gap/space. This exhausted/leaked hot air may flow in undesirable manner for example into the door instead of exiting the cooking appliance may occur. This may heat up the door or interfere with any air flows of the door for cooling the door.

The present technique (as described by the appended claims) may be understood in the context of the above structure.

However, the present technique is not limited to the above structure and may be applied to other structures too. The following presents another example, not limiting the present technique, of a cooking appliance for understanding an exemplary embodiment of the present technique.

Related Art Document 1 (Korean Patent Publication no. 10-2015-0030016) discloses an oven.

As illustrated in FIGS. 15 and 16, an oven 1 disclosed in Related Art Document 1 may include a casing 10 having a cooking chamber 20 provided therein and a door 30 configured to open and close an open front of the cooking chamber 20.

The cooking chamber 20 is a cooking space formed by an upper plate 21, a bottom plate 22, both side plates 23, and a rear plate 24. Various components constituting the oven 1 may be embedded in a space between the casing 10 and an outer portion of the cooking chamber 20 (hereinafter referred to as "electric component chamber"). A control panel 12 for controlling an operation of the oven 1 may be installed at an upper end of the casing 10.

A cooling fan 50 may be installed at an outer side of the upper plate 21. The cooling fan 50 may introduce outside air into the electric component chamber through at least one opening installed in a rear plate 11 or the like of the casing 10 and then discharge the air introduced into the electric component chamber back to the outside.

A cooling flow path 55 may be provided inside the electric component chamber. The cooling flow path 55 forms a passage that allows air suctioned by the cooling fan 50 to flow toward a front surface of the oven 1.

A cooling discharge port 57 may be provided at a front side of the cooling flow path 55. Air passing through the cooling flow path 55 may be discharged to an upper portion of the door 30 through the cooling discharge port 57. The cooling discharge port 57 may be positioned further toward the rear than the door 30.

A cooling guide 80 may be installed at a front-side end of the cooling discharge port 57. The cooling guide 80 may be provided in the form of a bracket that is bent to reduce the width of the cooling discharge port 57.

In the cooling discharge port 57 whose width is reduced due to the cooling guide 80, a phenomenon in which the flow speed of air passing through the cooling discharge port 57 increases may occur. Accordingly, while air passing through the cooling discharge port 57 is discharged to the outside of the oven 1 at a high speed, a phenomenon may occur in which, as pressure of the cooling discharge port 57 is decreased, air around the cooling discharge port 57 gathers around the cooling discharge port 57.

In this way, due to a force caused by air around the cooling discharge port 57 gathering to a portion above the door 30, air inside the door 30 may be guided to be discharged to the portion above the door 30.

By guiding air inside the door 30 to be discharged as above, Related Art Document 1 has an effect that the introduction of cold air into the door 30 is activated and air discharged through the cooling discharge port 57 is suppressed from flowing backward into the door 30.

However, Related Art Document 1 has the following problems.

According to Related Art Document 1, air passing through the cooling discharge port 57 and air discharged from the door 30 are discharged to a space positioned in front of the cooling discharge port 57 and above the door 30.

That is, as air discharged through the cooling discharge port 57 and air discharged from inside the door 30 are mixed in one space, a vortex may be generated in the corresponding space. As the vortex is generated in this way, air passing through the cooling discharge port 57 and air discharged from the door 30 may not be properly discharged to the outside of the oven 1, and a phenomenon in which air in the corresponding space flows backward into the door 30 may occur.

In this case, it is challenging to properly cool the inside of the electric component chamber and the inside of the door 30.

Also, in Related Art Document 1, the cooling guide 80 extends in the longitudinal direction of the cooling discharge port 57 along a portion under the cooling discharge port 57, and the cooling guide 80 is fixed to the portion under the cooling discharge port 57.

In order to install the cooling guide 80, it is may be necessary/advantageous to additionally perform a task of fixing the cooling guide 80 to the portion under the cooling discharge port 57. Here, when tasks of setting the position of the cooling guide 80 and fixing the cooling guide 80 are not properly performed, it may be difficult for air to be properly discharged through the cooling discharge port 57 as intended.

Also, when the cooling discharge port 57 is formed to be divided into a plurality of cooling discharge ports 57 in the width direction of the oven 1, the cooling guide 80 fixed to the portion under the cooling discharge port 57 is also provided as a plurality of cooling guides 80.

In this case, there may be a problem that the number of assemblers and the number of components necessary to install the cooling guides 80 are further increased, and the level of difficulty of installing the cooling guides 80 is further increased.

Also, when the cooling discharge port 57 is provided to continuously extend in the width direction of the oven 1, that is, only a single long cooling discharge port 57 is formed in the oven 1, the strength of the front surface of the casing 10 may be weakened.

The above reference is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
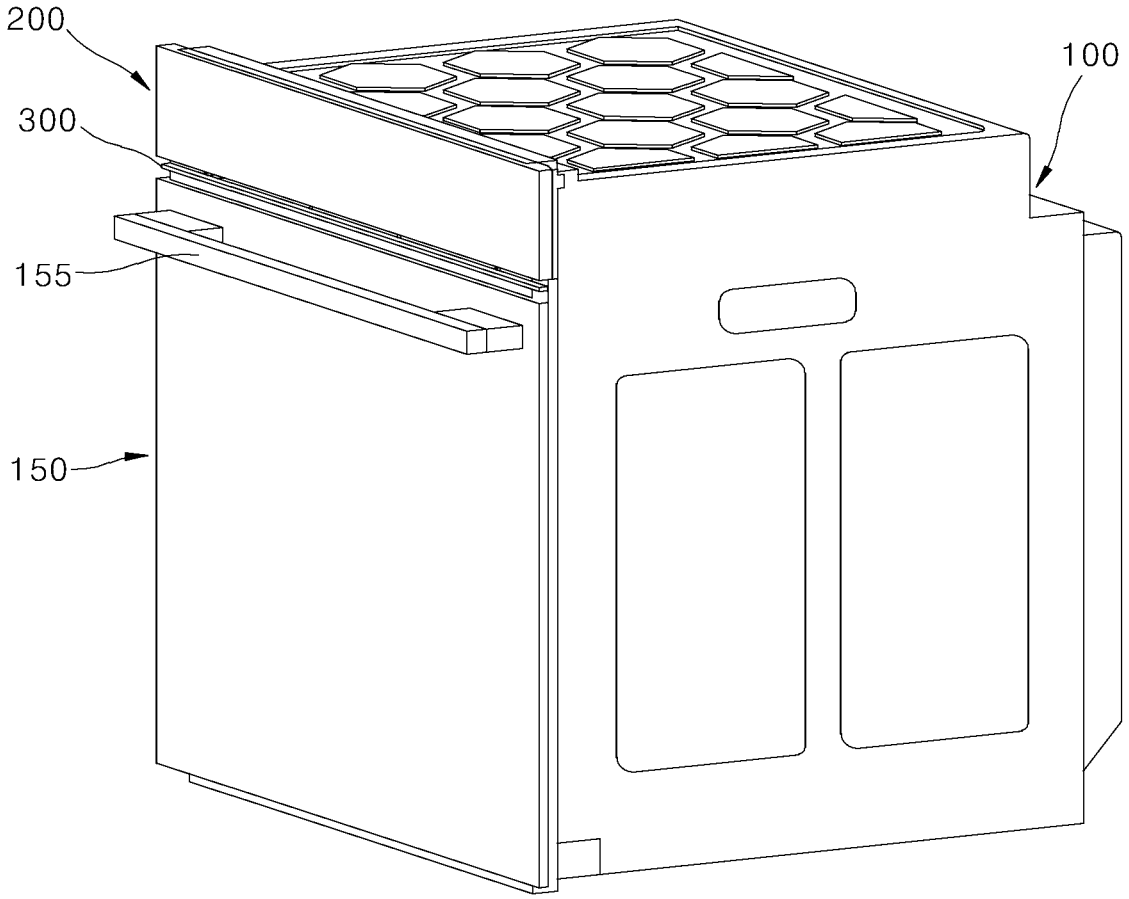
FIG. 1 is a perspective view illustrating a cooking appliance according to one embodiment of the present disclosure.

The objectives, features, and advantages will be described in detail below with reference to the accompanying drawings, and accordingly, those of ordinary skill in the art to which the present disclosure pertains should be able to easily practice the technical idea of the present disclosure. In describing the present disclosure, when it is determined that detailed description of a known art related to the present disclosure may unnecessarily obscure the gist of the present disclosure, the detailed description thereof will be omitted. Hereinafter, exemplary embodiments according to the present disclosure will be described in detail with reference to the accompanying drawings. In the drawings, the same reference numerals are used to indicate the same or similar components.

Although terms such as first and second are used to describe various components, of course, the components are not limited by the terms. The terms are only used to distinguish one component from another component, and of course, a first component may also be a second component unless otherwise stated.

The present disclosure is not limited to the embodiments disclosed below and may be changed in various ways and implemented in various different forms. The present embodiments make the present disclosure complete and are provided to completely inform those of ordinary skill in the art of the scope of the disclosure. Therefore, the present disclosure should be understood as, instead of being limited to the embodiments disclosed below, including all changes, equivalents, or substitutes included in the technical idea and scope of the present disclosure as well as any substitution or addition made between a configuration of any one embodiment and a configuration of another embodiment.

The accompanying drawings are only provided to facilitate understanding of the embodiments disclosed herein, and the technical idea disclosed herein is not limited by the accompanying drawings and should be understood as including all changes, equivalents, or substitutes included in the idea and technical scope of the present disclosure. In the drawings, sizes or thicknesses of components may be exaggerated or reduced in consideration of convenience of understanding, etc., but the protection scope of the present disclosure should not be construed as being limited thereby.

The terms used herein are only used to describe specific implementation examples or embodiments and are not intended to limit the present disclosure. Also, a singular expression includes a plural expression unless the context clearly indicates otherwise. In this specification, terms such as "include" or "consist of" are intended to designate that features, numbers, steps, operations, components, parts, or combinations thereof described herein are present. That is, in this specification, the terms such as "include" or "consist of" should not be understood as precluding the possibility of presence or addition of one or more other features, numbers, steps, operations, components, parts, or combinations thereof.

Terms including ordinals such as "first" and "second" may be used to describe various components, but the components are not limited by the terms. The terms are only used for the purpose of distinguishing one component from another component.

When a certain component is mentioned as being "connected" or "linked" to another component, although the certain component may be directly connected or linked to the other component, it should be understood that another component may be present therebetween. On the other hand, when a certain component is mentioned as being "directly connected" or "directly linked" to another component, it should be understood that other components are not present therebetween.

When a certain component is mentioned as being "on" or "under" another component, it should be understood that the certain component may be disposed directly on the other component or another component may be present therebetween.

Unless otherwise defined, all terms including technical or scientific terms used herein have the same meaning as commonly understood by one of ordinary skill in the art to which the present disclosure pertains. Terms, such as those defined in commonly used dictionaries, should be construed as having a meaning that is consistent with their meaning in the context of the relevant art and are not to be construed in an idealized or overly formal sense unless expressly so defined herein.

A direction in which a door is installed/disposed with respect to a center of a cooking appliance and/or with respect to a cooking space/chamber or a center of the cooking space defined in the cooking appliance (for example in a state in which the cooking appliance is placed on a floor or surface, e.g. for intended use) is defined or referred to as 'forward'. A direction towards/approaching from the door e.g. door in its closed state) toward an inside of the cooking appliance and/or the center of a cooking appliance and/or the cooking space/chamber and/or the center of the cooking space/chamber defined in the cooking appliance (for example in a state in which the cooking appliance is placed on a floor or surface, e.g. for intended use) is defined or referred to as 'rearward'. For convenience, a forward-rearward direction may be referred to as a first direction or forward-rearward direction (or axis or extension) or an axial (or depth) direction from the door in closed state to an inside of the cooking chamber/space. Then, forward may be referred to as one side of the first direction, and rearward may be referred to as the other/opposite side of the first direction.

Also, a direction of gravity or a direction from the cooking chamber/space (vertically downward) towards a floor or surface on which the cooking appliance is installed for use i.e. in upright manner may be defined or referred to as 'downward', and a direction opposite to the direction of gravity may be defined as 'upward'. For convenience, the upward direction and the downward direction can be referred to as a upward-downward direction (or axis or extension) or an vertical direction or up-down direction or height or height direction.

Also, a horizontal direction orthogonal to the front-rear direction of the cooking appliance, that is, a width direction of the cooking appliance when the cooking appliance is viewed from in front of the door of the cooking appliance, may be referred to as a left-right direction or lateral direction or width or width direction. For convenience, the left-right direction may be referred to as a second direction. Then, rightward may be referred to as one side of the second direction, and leftward may be referred to as the other/opposite side of the second direction.

Also, the width direction of the cooking appliance may also be referred to as a lateral direction. Then, rightward may be referred to as one side of the lateral direction, and leftward may be referred to as the other/opposite side of the lateral direction.

Also, the above-described up-down direction may be referred to as a third direction. Then, upward may be referred to as one side of the third direction, and downward may be referred to as the other/opposite side of the third direction.

Also, the above-described up-down direction may be referred to as a vertical direction. Then, both the front-rear direction and the left-right direction, that is, the first direction and the second direction, may be referred to as a horizontal direction.

The first direction, the second direction and the third direction may be mutually perpendicular i.e. the first direction is perpendicular to each of the second and the third directions, the second direction is perpendicular to each of the first and the third directions, and the third direction is perpendicular to each of the first and the second directions. Similarly, the vertical direction, the lateral direction and the axial direction may be mutually perpendicular. Throughout the specification, "A and/or B" may refer to A, B, or A and B unless particularly described otherwise, and "C to D" may refer to C or more and D or less unless particularly described otherwise.

[Overall Structure of Cooking Appliance]

Figure 2:
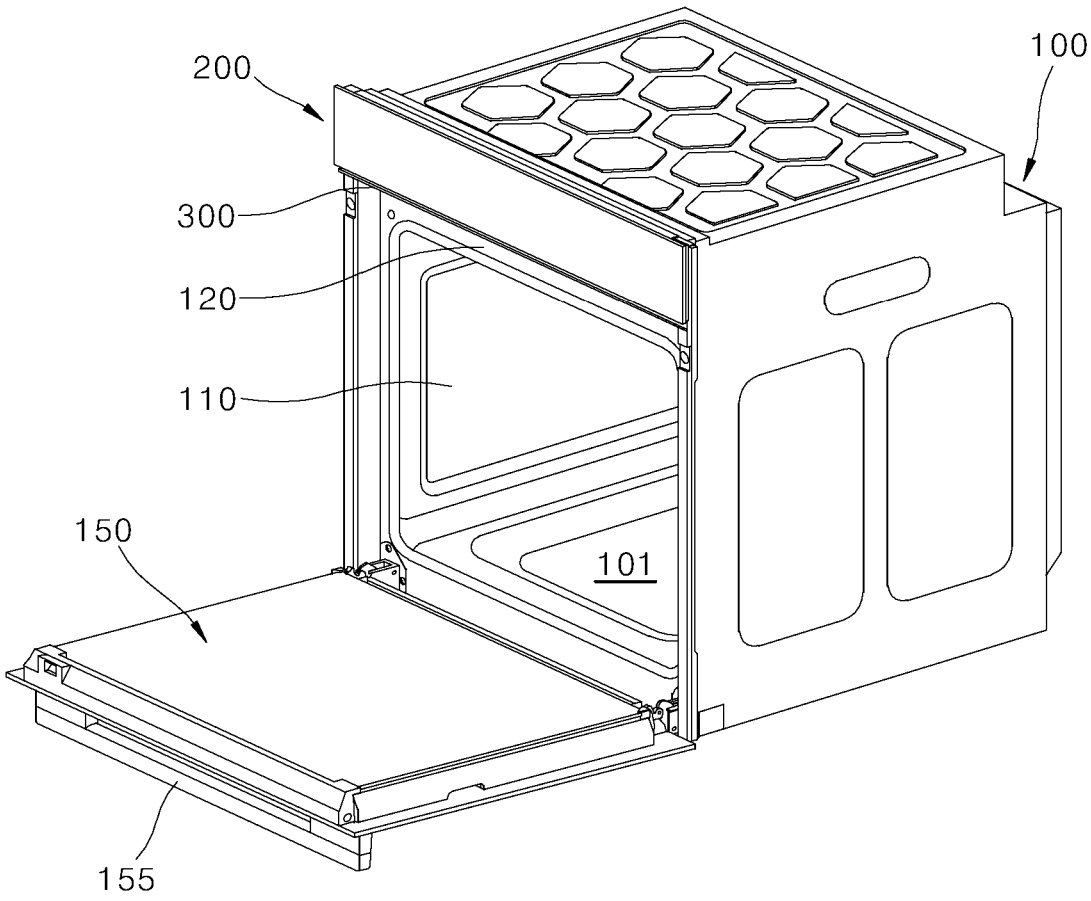
FIG. 2 is a perspective view showing an open state of a cooking chamber of the cooking appliance illustrated in FIG. 1.

FIG. 1 is a perspective view illustrating a cooking appliance according to one embodiment of the present disclosure, and FIG. 2 is a perspective view showing an open state of a cooking chamber of the cooking appliance illustrated in FIG. 1. Also, FIG. 3 is a perspective view showing an open state of a control panel of the cooking appliance illustrated in FIG. 1, and FIG. 4 is a lateral cross-sectional view showing an internal structure of the cooking appliance illustrated in FIG. 1.

Figure 3:
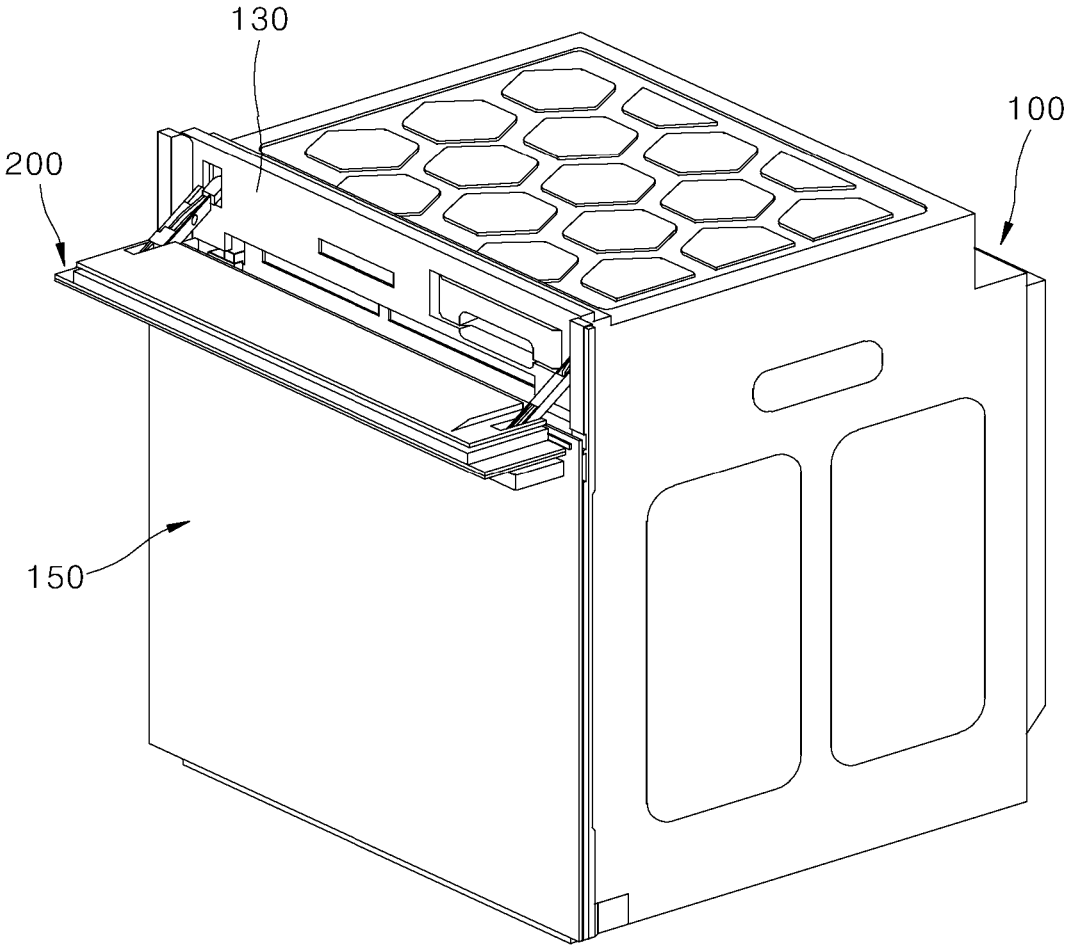
FIG. 3 is a perspective view showing an open state of a control panel of the cooking appliance illustrated in FIG. 1.
Figure 4:
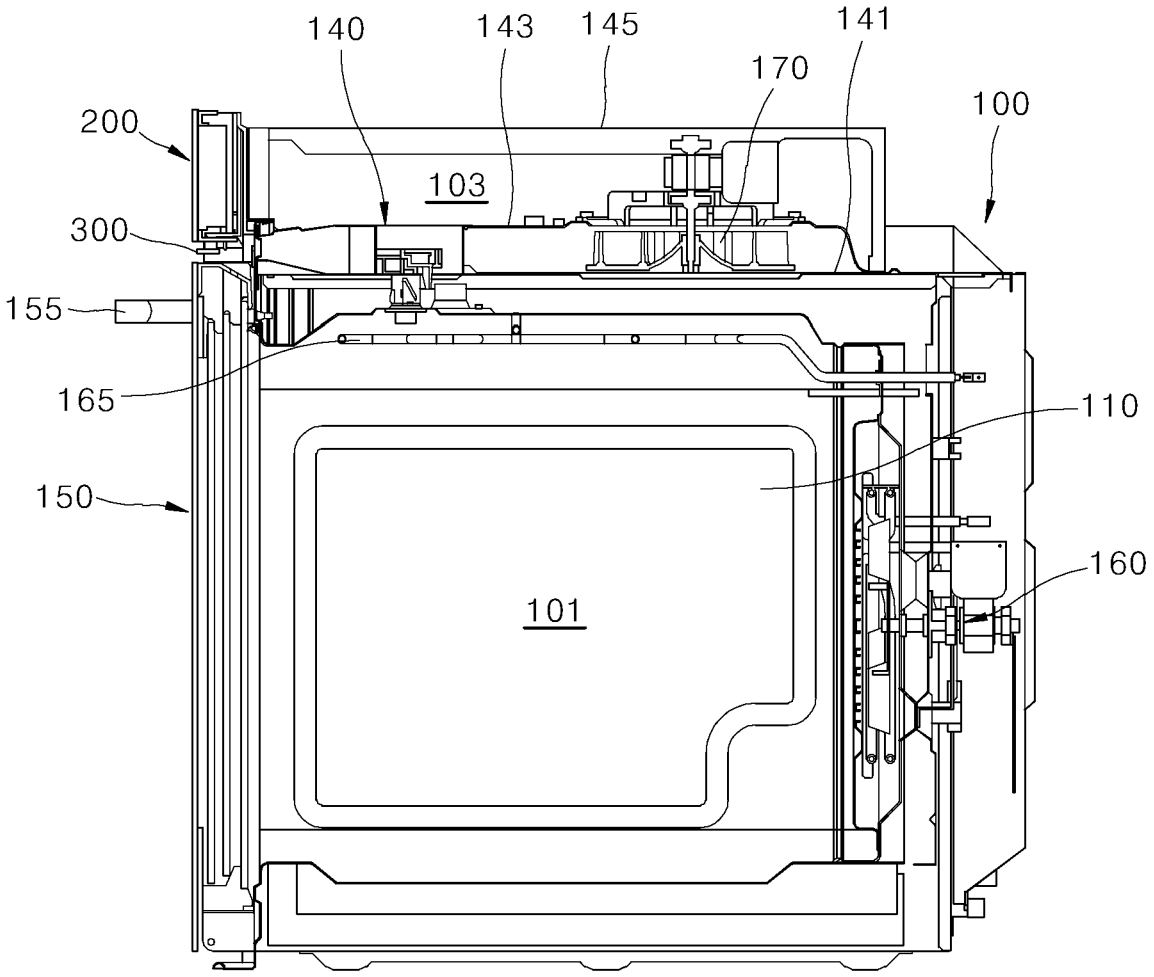
FIG. 4 is a lateral cross-sectional view showing an internal structure of the cooking appliance illustrated in FIG. 1.

Referring to FIGS. 1 to 3, an exterior of the cooking appliance may be formed by a main body 100. Optionally, the main body 100 may be provided in a form that includes a substantially rectangular parallelepiped shape or box shape. The main body 100 may be formed of a material having a predetermined strength in order to protect a plurality of components installed in an inner space thereof.

The main body 100 may include a cavity 110. The cavity 110 may form the frame/core of the main body 110.

Also, the main body 100 may further include front panels 120 and 130, including a first front panel 120.

The first front panel 120 may be disposed between the cavity 110 and a door 150. The first front panel 120 may be disposed at a front side of the cavity 110 and form a front surface of the main body 100. The first front panel 120 may define the cavity 110 at a front surface or front side or front of the cavity 110.

As another example, the first front panel 120 may not be separately provided from the main body/cavity 110, and a front surface of the main body/cavity 110 may form the front surface of the main body 100.

For example, the cavity 110 and the first front panel 120 may be integrally formed with each other and provided in the main body 100. For example the front panel 120 may be an integral part of the main body.

A cooking chamber 101 may be formed inside the main body/cavity 110. Also, an opening 126 configured to open the cooking chamber 101 forward may be formed inside the first front panel 120 or in front of the cavity. In the present technique, the cooking chamber 101 and the cavity 110 may mean one and the same thing. In other words, the main body includes a cavity/space formed therein which is the cooking chamber—accessible when the door is in open position and configured to receive items therein.

The cooking chamber 101 may be formed in a hexahedral shape with an open front surface. In a state in which the cooking chamber 101 is closed, the cooking appliance may heat an inner space of the cooking chamber 101 to cook food. That is, in the cooking appliance, the inner space of the cooking chamber 101 is a space where food is actually cooked.

A heating portion configured to heat the cooking chamber 101 may be provided in the cooking appliance. As an example of the heating portion, a convection portion 160 configured to cause convection of hot air to heat the inner space of the cooking chamber 101 may be provided as the heating portion at a rear side of the cooking chamber 101. Also, an upper heater 165 or an upper burner configured to heat the inner space of the cooking chamber 101 from an upper side may be provided as the heating portion at an upper side of the cooking chamber 101. Also, a lower heater or a lower burner configured to heat the inner space of the cooking chamber 101 from a lower side may also be provided as the heating portion at a lower side of the cooking chamber 101.

The door 150 configured to selectively open or close the cooking chamber 101 may be rotatably provided at a front side of the main body 100. The door 150 may open or close the cooking chamber 101 by being operated in a pull-down manner in which an upper end of the door 150 vertically rotates about a lower end thereof.

The door 150 may be formed in a hexahedral shape having a predetermined thickness as a whole. Also, a handle 155 or holding space provided to be gripped by a user when the user wants to rotate the door 150 may be installed at a front surface of the door 150.

Also, a see-through window may be provided at the door 150. The see-through window may be implemented using a transparent material such as glass or transparent plastic. According to a cooking appliance to which the see-through window is applied, it may be advantageous to form the see-through window to withstand high temperature and high pressure, and it may also be advantageous to add functions such as waterproofing and heat-proofing to the see-through window.

An electric component space 103 may be provided at a portion outside the cavity 110, more specifically, at an upper side of the cavity 110/cooking chamber. The electric component space 103 may be disposed at an upper side of the cavity 110 and the cooking chamber 101 formed therein. A space for installing electric components may be formed inside the electric component space 103.

A front surface of the electric component space 103 may be covered by the front panels 120 and 130. A second front panel 130 may be provided as one of the front panels 120 and 130.

The second front panel 130 may block a front side of the electric component space 103 and may be disposed between the electric component space 103 and a control panel 200.

As an example, the second front panel 130 may be disposed at an upper side of the first front panel 120 and may be coupled to the first front panel 120. Optionally at least a part of or entire second front panel 130 is arranged to overlap with the first front panel 120 at the upper side of the first front panel 120), and coupled to the first front panel 120. Alternatively, the second front panel 130 and the first front panel 120, may be flush with each other or may be integrally formed.

The second front panel 130 may protrude to a portion above the cavity 110 and define a front boundary surface of the electric component space 103. More specifically, most of the front side of the electric component space 103 is blocked by the second front panel 130. Also, a portion of the front side of the electric component space 103, that is, a portion of a lower side of the electric component space 103, may be blocked by the first front panel 120.

Meanwhile, an exhaust port 122 may be provided in the front panels 120 and 130. In the present embodiment, the exhaust port 122 is provided in the first front panel 120.

The exhaust port 122 may be formed to pass through the first front panel 120 in the front-rear direction. The exhaust port 122 may form a passage in the first front panel 120 to allow air inside the electric component space 103 to pass through the first front panel 120 and be discharged to the outside of the electric component space 103.

As another example, the first front panel 120 may not be separately provided from the cavity 110, and the front surface of the cavity 110 may form the front surface of the main body 100. In this case, the exhaust port 122 may be provided in the front surface of the cavity 110 that is formed in a shape corresponding to the shape of the first front panel 120.

The control panel 200 may be provided at an upper portion of the front surface of the cooking appliance, that is, at a front surface of the portion above the cavity 110. The control panel 200 may form a portion of the front exterior of the cooking appliance.

The control panel 200 may be disposed at the front side of the electric component space 103. Also, the control panel 200 may be disposed at a front side of the second front panel 130.

As illustrated in FIGS. 3 and 4, the control panel 200 may be provided to open and close the electric component space 103 or the second front panel 130. The control panel 200 is provided to rotate between a closing position at which the control panel 200 blocks the electric component space 103 or the second front panel 130 and an opening position at which the control panel 200 opens the electric component space 103 or the second front panel 130 forward.

When the control panel 200 rotates from the closing position to the opening position, the control panel 200 may rotate about a lower end thereof and be unfolded forward. Here, a back surface of the control panel 200 faces upward, and a front surface of the control panel 200 faces downward.

When the control panel 200 rotates from the opening position to the closing position, the control panel 200 may rotate about the lower end thereof and stand upright in the vertical direction. The control panel 200 may stand parallel to the second front panel 130 and block the second front panel 130 from the front side thereof. Here, the front surface of the control panel 200 faces forward, and the back surface of the control panel 200 faces rearward.

The operation of opening or closing the control panel 200 may be automatically performed by a separate opening/closing device or may be manually performed.

A display may be provided on the control panel 200. The display may include an input portion allowing an operation of the cooking appliance to be controlled and a display configured to display an operational state of the cooking appliance.

As an example, the input portion and the display may be configured by a single panel. For example, the input portion and the display may be formed as a touch panel that receives a touch input of a user. The display may display a user interface (UI) or a graphic user interface (GUI) relating to the operation of the cooking appliance.

A plurality of buttons may be displayed on the control panel 200 having the display. For example, a button for setting the operation of the heating portion may be displayed on the control panel 200. Also, a button for setting the operation of opening or closing the control panel 200 may be displayed on the control panel 200.

As another example, the control panel may be provided in the form of a simple panel that does not include the input portion, the display, or the like. Even the control panel in this form may be disposed at the front side of the electric component space 103 to cover the electric component space 103, may rotate downward to move to the opening position, and may be unfolded forward at the opening position, like the control panel 200 described above.

As still another example, the control panel may be provided so that only a portion of the control panel can be opened. For example, a structure in which the control panel is divided into a plurality of areas in the lateral direction may be applied. In this case, among the plurality of areas of the control panel, only an area that covers a water tank from a front side may rotate downward and be unfolded forward, and the remaining areas may be fixed and not be opened.

As yet another example, a structure in which the control panel is divided into a plurality of areas in the up-down direction, and among the plurality of areas, only an upper area that covers the water tank from the front side rotates downward and is unfolded forward may be applied.

[Structure of Door]

Referring to FIGS. 1 to 3, the door 150 may include a door frame 151 and a front glass 153.

The door frame 151 may form the frame of the door 150 and may form an exterior of an upper surface, a bottom surface, and side surfaces of the door 150. The door frame 151 may be formed in a hexahedral shape with an open front surface and an open rear surface.

A hinge configured to rotatably couple the door frame 151 to the main body 100 may be installed at a lower side of the door frame 151. The hinge may be installed at a lower end of the door frame 151 and may be installed at both sides of the door frame 151 in the lateral direction.

The front glass 153 may be disposed at a front side of the door frame 151. The front glass 153 may be coupled to the door frame 151 at the front side of the door frame 151 and may form the front exterior of the door 150.

Also, the door 150 may further include a rear glass 156. The rear glass 156 may be coupled to the door frame 151 at a rear side of the door frame 151 and may form the back exterior of the door 150.

Also, the door 150 may further include an inner glass 154. In the present embodiment, the door 150 includes a plurality of inner glasses 154. The inner glass 154 may be disposed at a rear side of the front glass 153 and a front side of the rear glass 156 and may be coupled to the door frame 151 at the rear side of the front glass 153 and the front side of the rear glass 156.

The plurality of inner glasses 154 may be disposed to be spaced apart at predetermined intervals in the front-rear direction inside the door 150. The plurality of inner glasses 154 may be disposed between the front glass 153 and the inner glass 154 disposed at the rearmost portion.

By the inner glasses 154 being disposed in this way, the inside of the door 150 may be divided into a plurality of spaces arranged in the front-rear direction. The plurality of inner glasses 154 disposed in this way may serve to suppress heat transferred from inside the cooking chamber 101 to the door 150 from being transferred to the front surface of the door 150.

Outside air may be introduced into the door 150 in which the inner glasses 154 are disposed as described above. For example, outside air may be introduced into the door 150 through the open lower end of the door 150. The air introduced into the door 150 in this way may pass through the door 150 and cool the door 150.

A door exhaust port 152 may be provided in the upper end of the door 150 that faces the control panel 200. The door exhaust port 152 may form a passage in the upper end of the door 150 to open the inside of the door 150 to the outside of the door 150. The door exhaust port 152 may be formed to pass through an upper end of the door frame 151 in the up-down direction.

According to the present embodiment, the upper end of the door frame 151 may be divided into a first half portion 150*a* and a second half portion 150*b*. The first half portion 150*a* may form a front side of the upper end of the door frame 151, and the second half portion 150*b* may form a rear side of the upper end of the door frame 151.

The first half portion 150*a* may be provided in a form that forms a plane in the horizontal direction orthogonal to an axis in the up-down direction. The second half portion 150*b* disposed at a rear side of the first half portion 150*a* may be provided in a form that forms an inclined surface inclined downward toward the rear.

The door exhaust port 152 may be provided in the upper end of the door 150 and provided on the second half portion 150*b*. Accordingly, the door exhaust port 152 may be disposed at a position biased toward the rear on the door 150 and may be disposed at a side that is lower than the uppermost end of the door 150 formed by the first half portion 150*a*.

[Structure Inside Electric Component Space]

A lower boundary surface of the electric component space 103 may be defined by an upper panel 140 disposed at an upper side of the cavity 110. Also, an upper boundary surface of the electric component space 103 may be defined by an electric component chamber cover 145 configured to cover the electric component space 103 from above.

Also, side boundary surfaces and a rear boundary surface of the electric component space 103 may be defined by both side surfaces and a back surface of the electric component chamber cover 145 or may be defined by both side surfaces of the cavity 110 that protrude to an upper side of the cooking chamber 101 and a back surface of the electric component chamber cover 145.

Various electric components may be disposed inside the electric component space 103 as described above. As an example thereof, a circuit board may be disposed inside the electric component space 103. Various devices, circuits, and the like relating to reception of manipulation signals input through the control panel 200, generation of control signals for controlling the operation of the heating portion, and the like may be provided on the circuit board.

A fan module 170 may be disposed inside the electric component space 103. The fan module 170 may be disposed at a position biased toward a side adjacent to a rear surface of the cavity 110, that is, a rear side inside the electric component space 103.

The fan module 170 may be formed to include a turbofan installed inside the electric component space 103. The fan module 170 may suction outside air through the rear side of the electric component space 103 and discharge the suctioned air forward.

By the operation of the fan module 170, outside air may be introduced into the electric component space 103 from the rear side and both lateral sides of the cooking appliance.

For example, outside air introduced through a lower portion of the main body 100 may be introduced into the electric component space 103 through an air hole 104 formed in the rear side of the electric component space 103 after passing through a rear-side space of the cooking appliance. Also, outside air may also be introduced into the electric component space 103 through an air hole 104 formed in any one lateral side of the electric component space 103.

The air introduced into the electric component space 103 in this way may move forward inside the electric component space 103 and cool the electric components inside the electric component space 103.

The air introduced into the electric component space 103 as described above may be suctioned into a duct portion 143 by the fan module 170. The air introduced into the duct portion 143 may be discharged to the front of the electric component space 103 through the exhaust port 122 after moving forward inside the duct portion 143.

[Front Space and Surrounding Structure Thereof]

Figure 5:
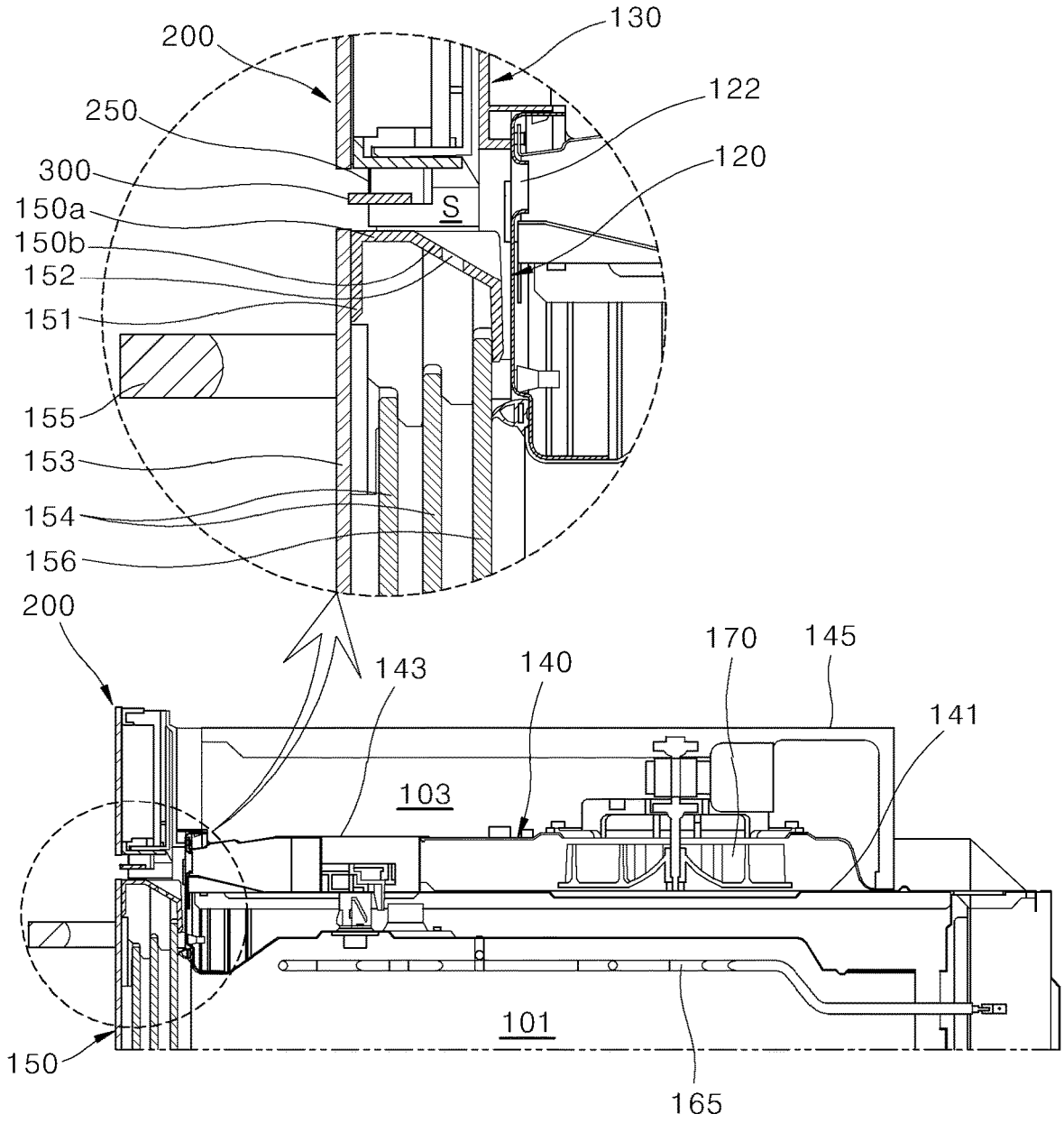
FIG. 5 is an enlarged view of a portion of the cooking appliance illustrated in FIG. 4.
Figure 6:
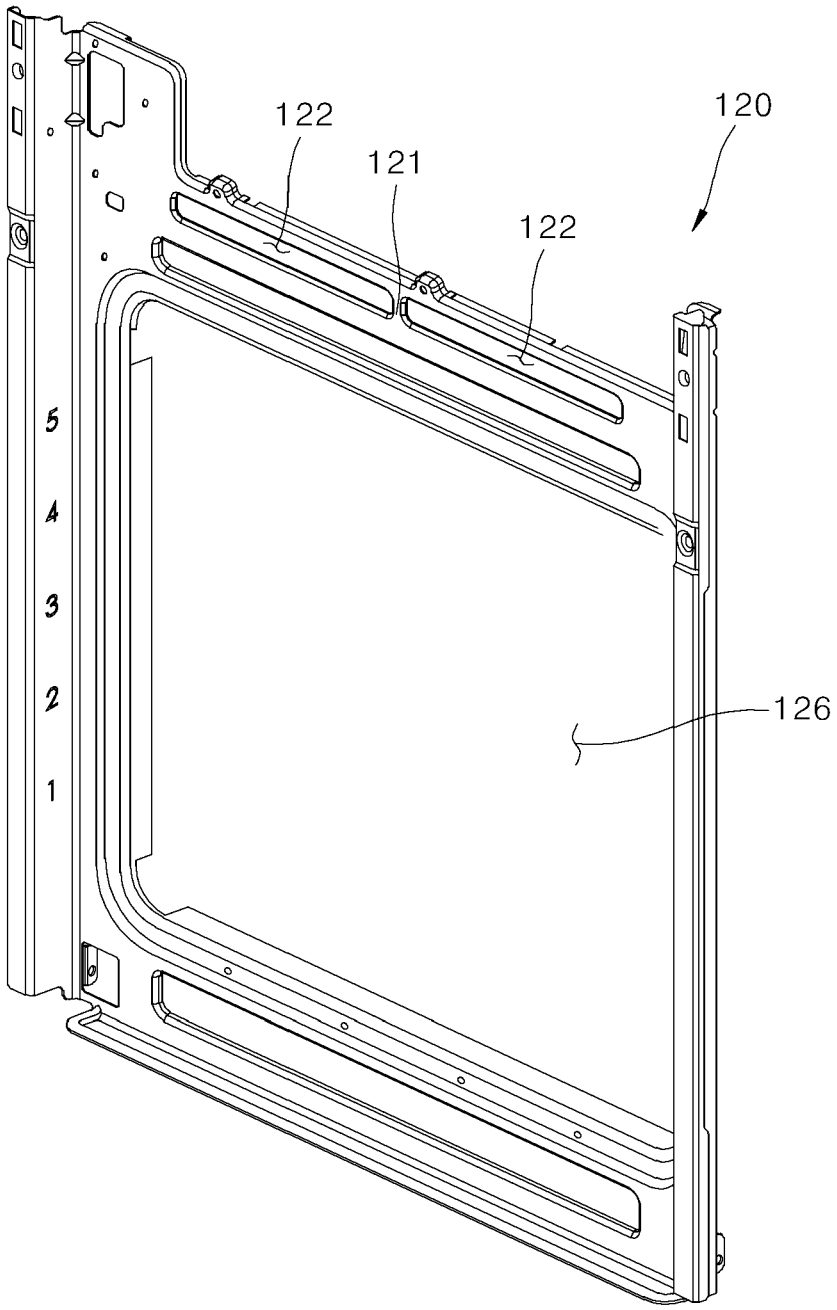
FIG. 6 is a perspective view separately illustrating a front panel illustrated in FIG. 4.

FIG. 5 is an enlarged view of a portion of the cooking appliance illustrated in FIG. 4, and FIG. 6 is a perspective view separately illustrating a front panel illustrated in FIG. 4.

Referring to FIGS. 4 and 5, a front space S may be formed at a front side of the electric component space 103. The front space S may be disposed at a front side of the first front panel 120. Also, the front space S may be disposed at a lower side of the control panel 200. Also, the front space S may be disposed at an upper side of the door 150 in a state in which the door 150 closes the cooking chamber 101.

In the present embodiment, the front space S is a space surrounded by the door 150, the first front panel 120, and the control panel 200. That is, the front space S may be a space disposed at the front side of the first front panel 120 and formed between the control panel 200 and the door 150.

The front space S may be exposed to the front of the cooking appliance through a gap between the control panel 200 and the door 150.

As illustrated in FIGS. 5 and 6, the exhaust port 122 may be disposed at a rear side of the front space S. As described above, the exhaust port 122 may be formed in the first front panel 120. Air cooling the electric components and flowing forward inside the electric component space 103 may be discharged to the front space S through the exhaust port 122.

According to the present embodiment, a plurality of exhaust ports 122 may be provided in the first front panel 120. The plurality of exhaust ports 122 may be disposed to be spaced apart at predetermined intervals in the lateral direction.

Also, a partition 121 may be formed between two exhaust ports 122 that are adjacent in the lateral direction. The partition 121 may support the first front panel 120 between the two adjacent exhaust ports 122 to improve the strength of the first front panel 120.

The door exhaust port 152 may be disposed at a lower side of the front space S. As described above, the door exhaust port 152 may be formed in the upper end of the door 150. Air cooling the door 150 and flowing upward inside the door 150 may be discharged to the front space S through the door exhaust port 152.

[Structure of Air Guide]

Figure 7:
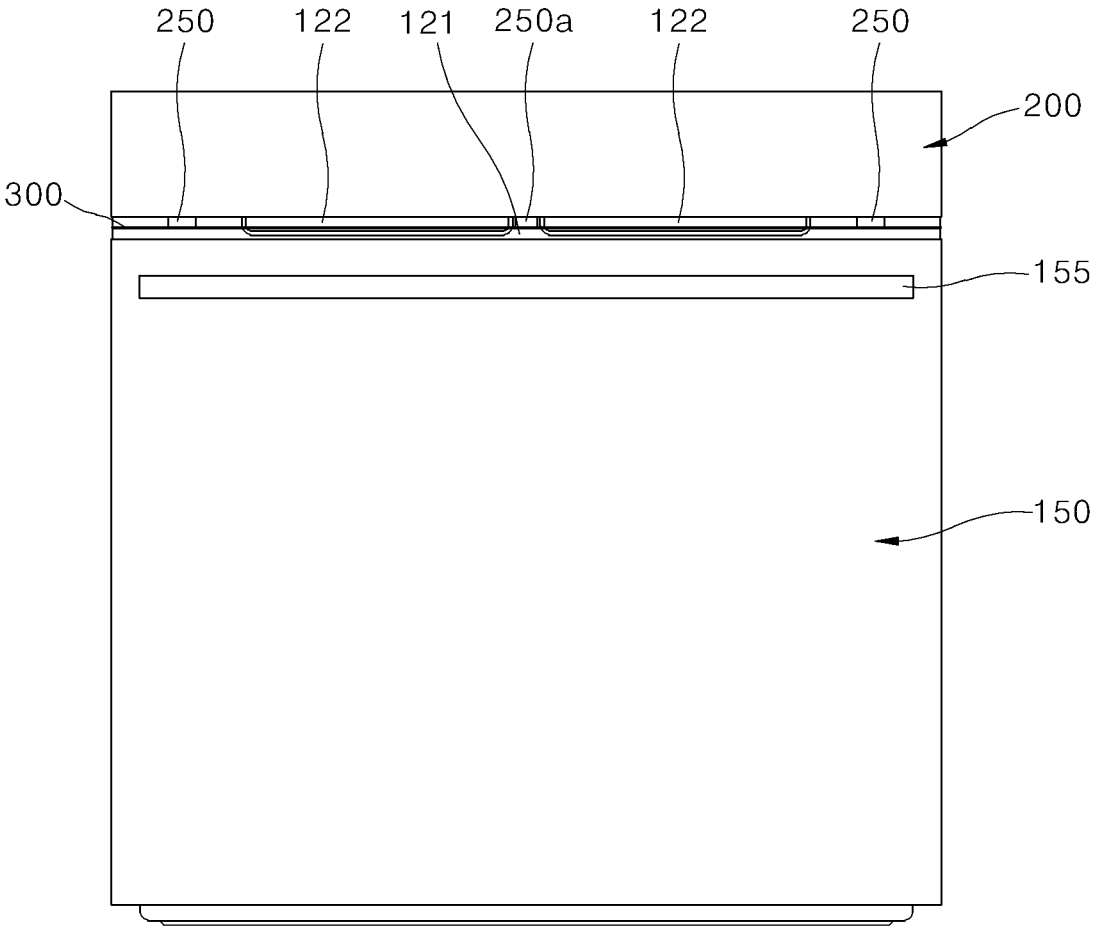
FIG. 7 is a front view illustrating a cooking appliance according to one embodiment of the present disclosure.
Figure 8:
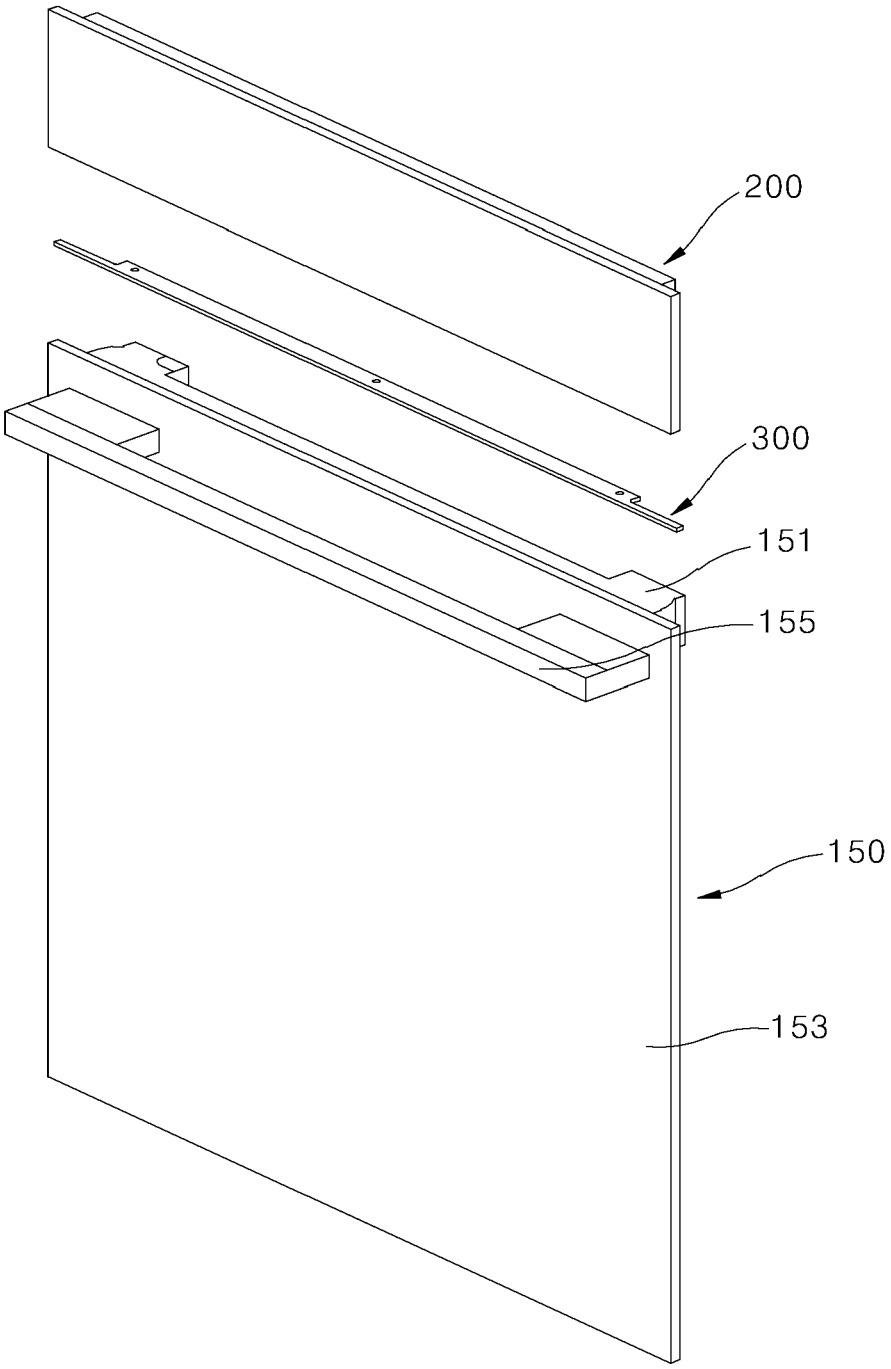
FIG. 8 is a front exploded perspective view illustrating an exploded state of a door, a control panel, and an air guide illustrated in FIG. 7.
Figure 9:
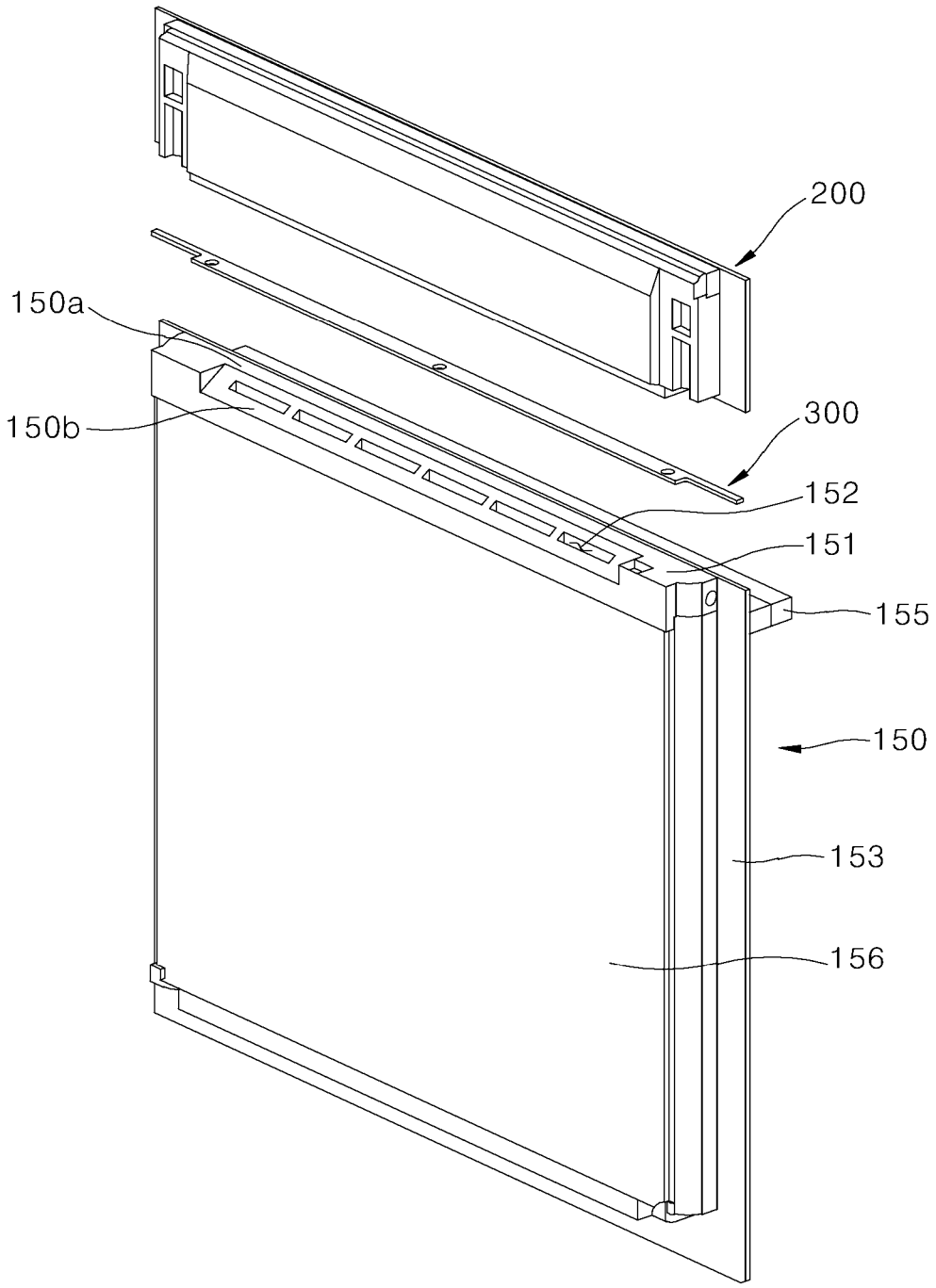
FIG. 9 is a back exploded perspective view illustrating the exploded state of the door, the control panel, and the air guide illustrated in FIG. 7.
Figure 10:
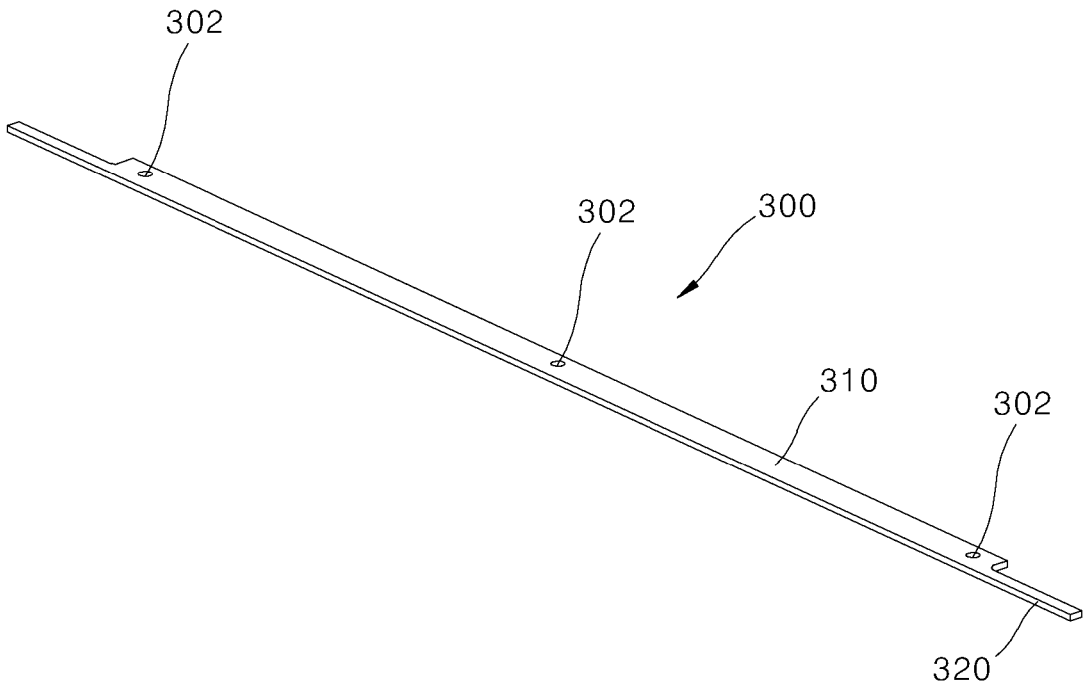
Figure 11:
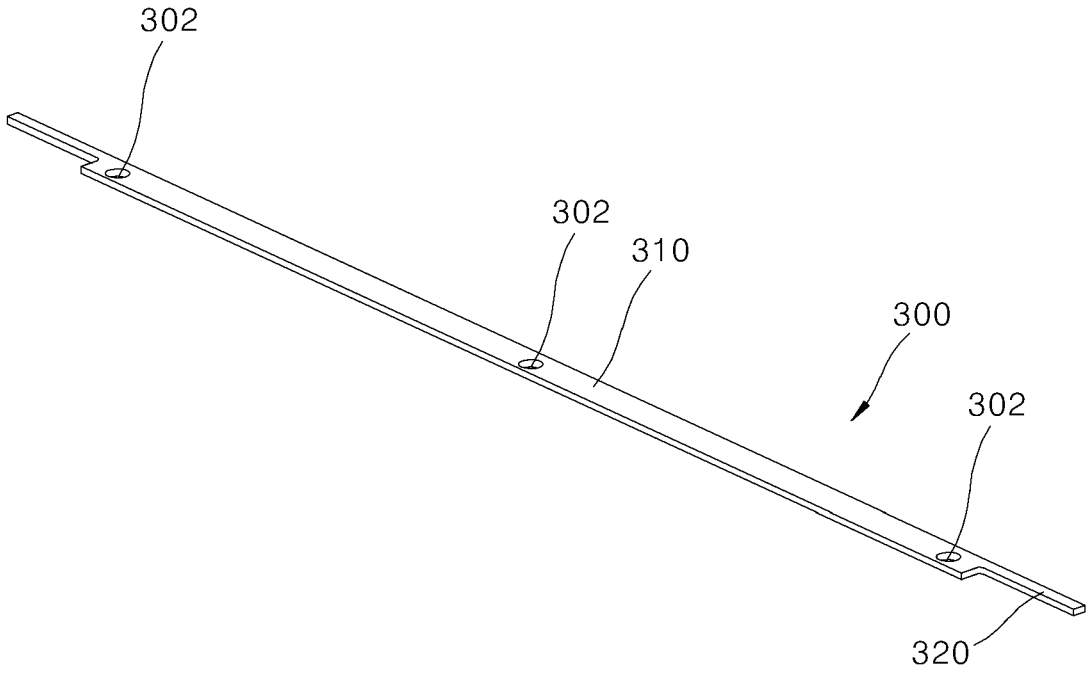
FIG. 11 is a bottom perspective view of the air guide illustrated in FIG. 10.

FIG. 7 is a front view illustrating a cooking appliance according to one embodiment of the present disclosure, FIG. 8 is a front exploded perspective view illustrating an exploded state of a door, a control panel, and an air guide illustrated in FIG. 7, and FIG. 9 is a back exploded perspective view illustrating the exploded state of the door, the control panel, and the air guide illustrated in FIG. 7. Also, FIG. 10 is a front perspective view separately illustrating an air guide according to one embodiment of the present disclosure, and FIG. 11 is a bottom perspective view of the air guide illustrated in FIG. 10.

Referring to FIG. 5 and FIGS. 7 to 9, the cooking appliance according to the present embodiment may further include an air guide 300.

The air guide 300 may be disposed between the door 150 and the control panel 200. More specifically, the air guide 300 may cover at least a portion of the first front panel 120 and be disposed between the door 150 and the control panel 200.

The air guide 300 may divide a space between the door 150 and the control panel 200 into upper and lower spaces.

Also, the air guide 300 may be disposed in a space surrounded by the door 150, the first front panel 120, and the control panel 200, that is, the front space S.

In the present embodiment, the air guide 300 is formed in the shape of a frame whose length in the lateral direction is extremely longer than the length in the front-rear direction and the length in the up-down direction. The air guide 300 may be formed in a shape in which the length in the front-rear direction is longer than the length in the up-down direction.

Hereinafter, the length/measure/extension distance of the air guide 300 in the front-rear direction will be referred to as "length/depth", the length/measure/extension distance of the air guide 300 in the lateral direction will be referred to as "width," and the length/measure/extension distance of the air guide 300 in the up-down direction will be referred to as "thickness."

According to the present embodiment, the air guide 300 may be formed in the shape of a frame in which the width is longer than the length/depth and the thickness, and the thickness is smaller than the length/depth and the width.

The length/measure/extension distance of the air guide 300 in the up-down direction, that is, the thickness, may be less than or equal to the length of the front space S in the up-down direction. The air guide 300 may be accommodated inside the front space S. Also, air discharged from the exhaust port 122 or the door exhaust port 152 may flow forward inside the front space S, pass through the air guide 300, and be discharged to the outside of the cooking appliance through the air guide 300.

The air guide 300 disposed in the front space S as described above may divide at least a portion of the front space S into a first space S1 and a second space S2.

The length/measure/extension distance of the air guide 300 in the lateral direction, that is, the width, may be a length that corresponds to the length/measure/extension distance of the front space S in the lateral direction. For example, the width of the air guide 300 may correspond to at least any one of or both of the length/measure/extension distance of the control panel 200 in the lateral direction and the length of the door 150 in the lateral direction.

In the present embodiment, the first space S1 may be defined as a space between the control panel 200 and the air guide 300, and the second space S2 may be defined as a space between the air guide 300 and the door 150.

More specifically, the first space S1 may be defined as a space between a first guide portion 310 (described below) and the control panel 200, and the second space S2 may be defined as a space between the first guide portion 310 (described below) and the door 150. The first space S1 and the second space S2 may be spaces obtained by the first guide portion 310 dividing the space between the door 150 and the control panel 200 into upper and lower spaces.

The air guide 300 may be disposed in the front space S and may be disposed in an area of the front space S that is biased toward the front. The air guide 300 may divide a front area of the front space S into the first space S1 and the second space S2.

Referring to FIG. 4 and FIGS. 10 and 11, the air guide 300 may include the first guide portion 310. The first guide portion 310 is a portion that occupies most of the area of the air guide 300 and may form a majority of the exterior of the air guide 300.

The first guide portion 310 may be disposed between the control panel 200 and the door 150 and divide the space between the control panel 200 and the door 150 into upper and lower spaces. The first guide portion 310 may divide the space between the control panel 200 and the door 150 into the first space S1 disposed at an upper side and the second space S2 disposed at a lower side.

As an example, the first guide portion 310 may be formed in the shape of a plane that is parallel to a bottom surface of the control panel 200 and/or an upper end surface of the door 150. For example, the first guide portion 310 may be formed in a shape that includes a plane orthogonal to the axis in the up-down direction.

Further, the air guide 300 may further include a second guide portion 320. The second guide portion 320 may be disposed at both sides of the first guide portion 310 in the lateral direction. The second guide portion 320 may be formed to protrude in the lateral direction from both ends of the first guide portion 310 in the lateral direction.

The second guide portion 320 is not a portion coupled to a first cover protrusion 250. Therefore, the length of the second guide portion 320 (the length thereof in the front-rear direction) may be set to be shorter than the overall length of the air guide 300.

Since the second guide portion 320 is formed so that the length of the second guide portion 320 is shorter than the overall length of the air guide 300, the overall size and weight of the air guide 300 may not be unnecessarily increased.

The second guide portion 320 may be disposed to be biased toward the front side on the air guide 300. Preferably, the first guide portion 310 and the second guide portion 320 may be connected in the lateral direction so that a front-side end of the second guide portion 320 and a front-side end of the first guide portion 310 are disposed to be collinear.

In the present embodiment, the second guide portion 320 protrudes from the first guide portion 310 while having the same thickness as the first guide portion 310.

Accordingly, when viewed from the front, the first guide portion 310 and the second guide portion 320 may seem smoothly connected. That is, the air guide 300 including the above-described second guide portion 320 may be formed so that an exterior of the air guide 300 viewed from the front is smoothly connected.

[Coupling Structure Between Control Panel and Air Guide]

Figure 12:
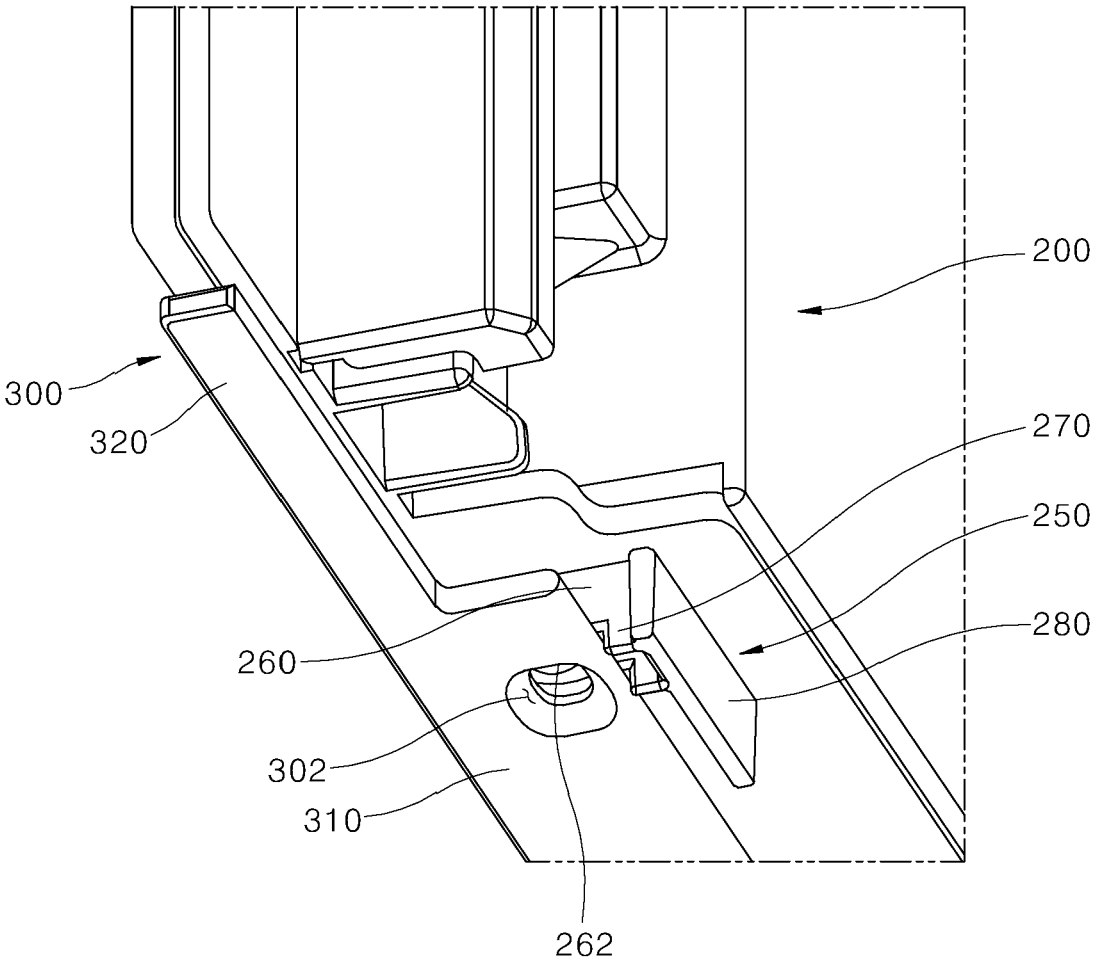
FIG. 12 is a bottom perspective view showing an installation structure of an air guide according to one embodiment of the present disclosure.
Figure 13:
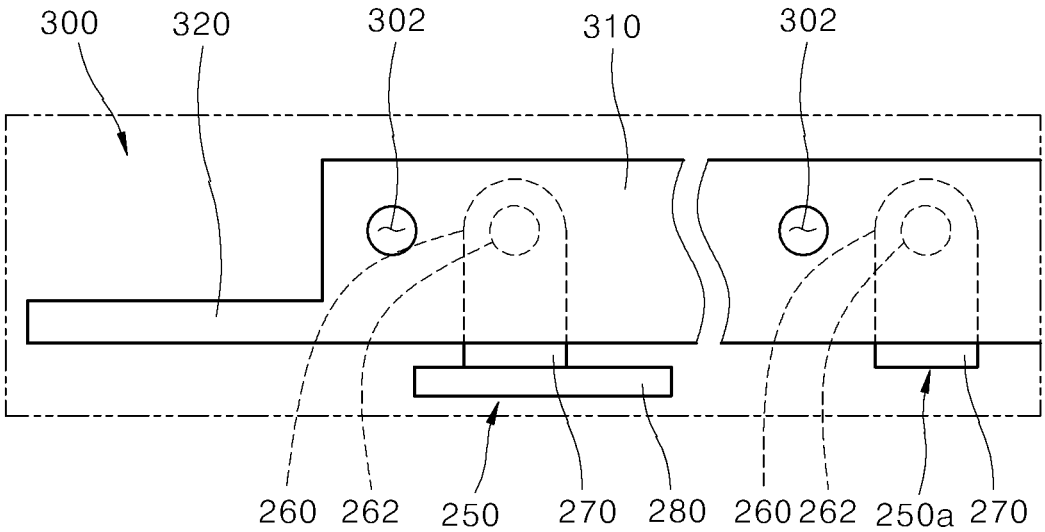
FIGS. 13 and 14 are bottom views showing the process of aligning the position of the air guide.
Figure 14:
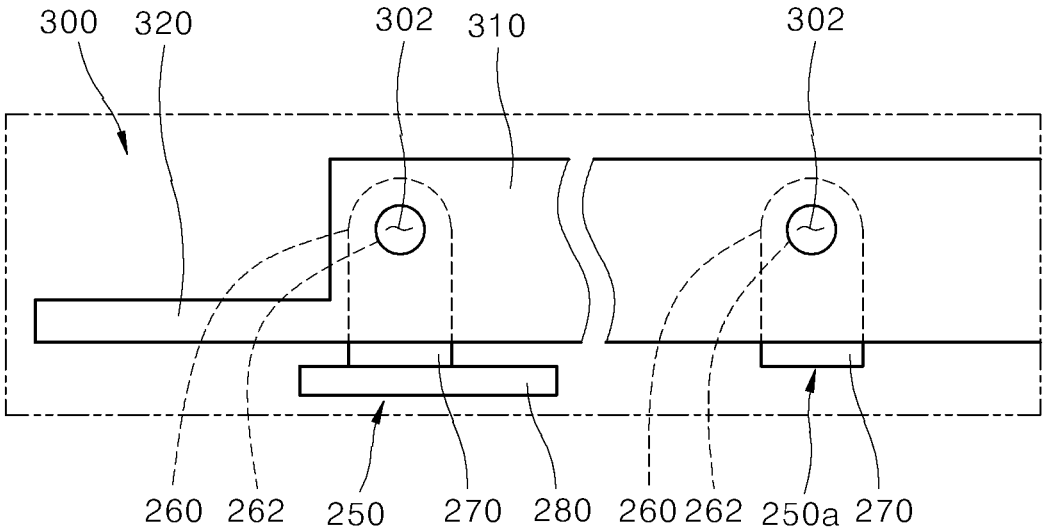
Figure 15:
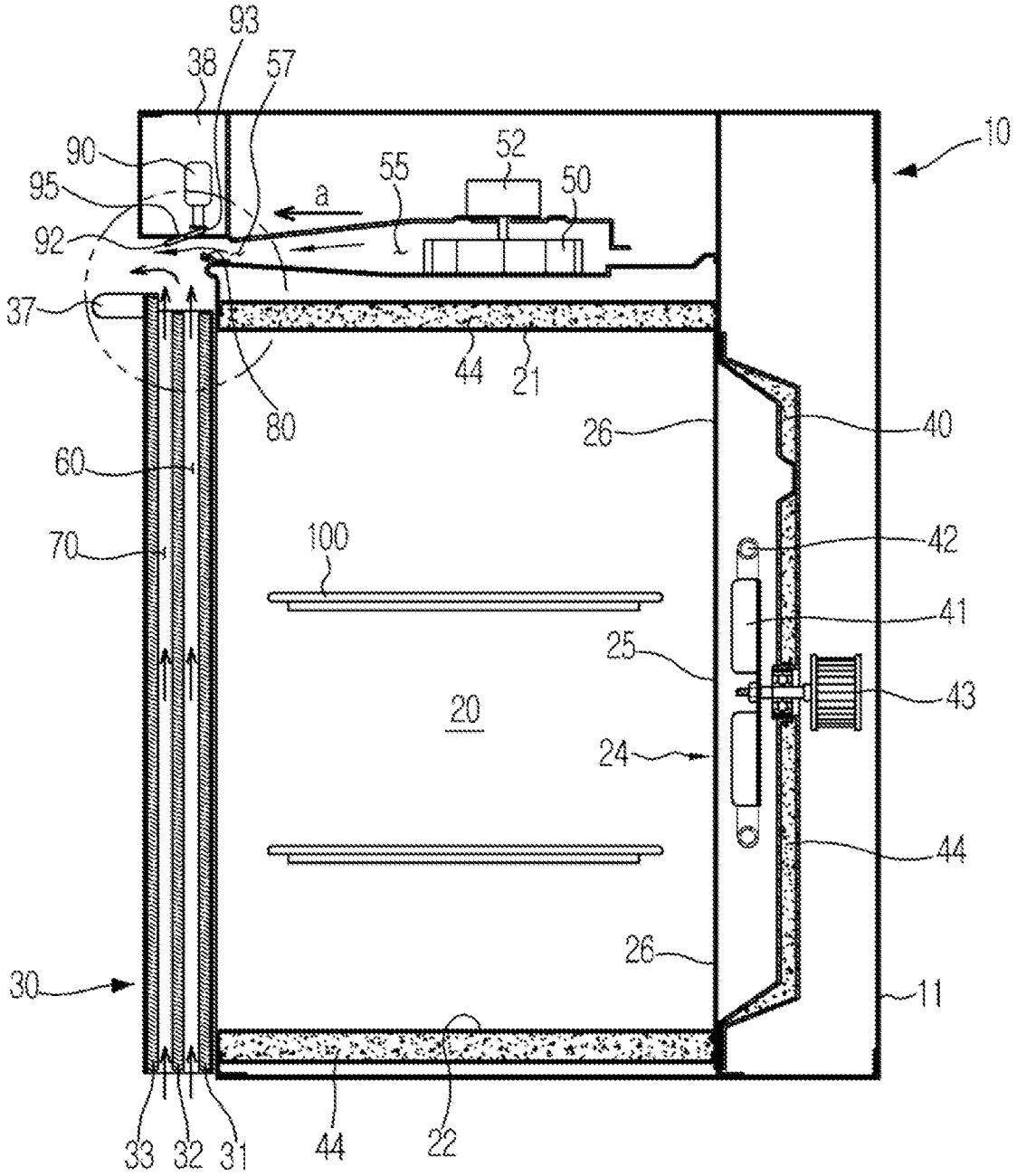
FIG. 15 is a lateral cross-sectional view showing an internal structure of a conventional oven.
Figure 16:
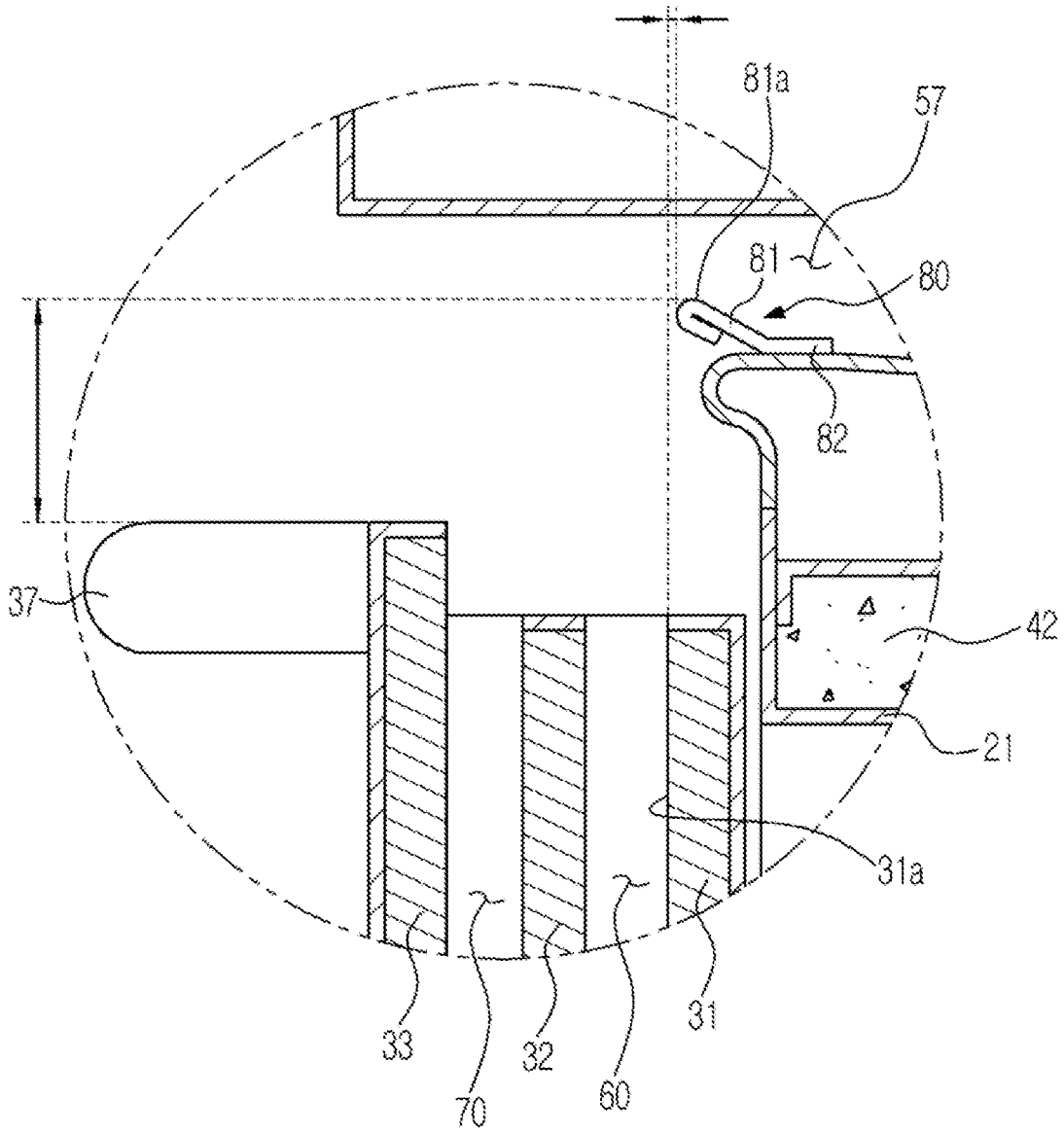
FIG. 16 is an enlarged view of a portion of FIG. 15.

FIG. 12 is a bottom perspective view showing an installation structure of an air guide according to one embodiment of the present disclosure, and FIGS. 13 and 14 are bottom views showing the process of aligning the position of the air guide.

As illustrated in FIG. 7 and FIGS. 12 and 13, the cooking appliance according to the present embodiment may further include the first cover protrusion 250.

The first cover protrusion 250 may be provided for coupling between the air guide 300 and the control panel 200 or coupling between the air guide 300 and the door 150. The first cover protrusion 250 may be formed to protrude from the door 150 or the control panel 200 toward the air guide 300. In the present embodiment, the air guide 300 is disposed at a lower side of the control panel 200 and coupled to the control panel 200. According thereto, the first cover protrusion 250 may be disposed between the control panel 200 and the air guide 300.

In the present embodiment, the first cover protrusion 250 is provided on the control panel 200. As another example, the first cover protrusion 250 may be provided on the air guide 300 or may be provided on the door 150. In this way, various modifications of the first cover protrusion may be possible.

The first cover protrusion 250 provided on the control panel 200 may be formed to protrude downward from a lower end of the control panel 200. The air guide 300 may be coupled to the first cover protrusion 250 at a position spaced apart from the lower end of the control panel 200.

In this way, the air guide 300 coupled to the first cover protrusion 250 may be disposed to be spaced a predetermined distance apart from the control panel 200 at a lower side of the control panel 200.

According to the present embodiment, a plurality of first cover protrusions 250 may be disposed to be spaced apart at predetermined intervals in the lateral direction. Also, by being coupled to each of the plurality of first cover protrusions 250, the air guide 300 may be stably fixed at the lower side of the control panel 200.

Each of the first cover protrusions 250 may include a fastening protrusion portion 260. The fastening protrusion portion 260 may be provided to be coupled to the air guide 300 while in contact with the air guide 300 in the vertical direction.

In the present embodiment, the fastening protrusion portion 260 is coupled to the air guide 300 while in contact with the air guide 300 in the up-down direction. The fastening protrusion portion 260 may be formed to protrude downward from the lower end of the control panel 200.

As an example, the fastening protrusion portion 260 may be formed in a substantially cylindrical shape, and a fastening hole 262 (hereinafter referred to as "first fastening hole 262") may be provided in the fastening protrusion portion 260. The first fastening hole 262 may be formed to pass through the fastening protrusion portion 260 in the vertical direction. In other words, the first fastening hole 262 may be formed as a hollow in the up-down direction in the fastening protrusion portion 260.

In order to correspond thereto, a fastening hole 302 (hereinafter referred to as "second fastening hole 302") may be provided in the air guide 300. The second fastening hole 302 may be formed to pass through the air guide 300, more specifically, the first guide portion 310, in the vertical direction or the up-down direction.

The air guide 300 may be coupled to the fastening protrusion portion 260. For example, in a state in which the air guide 300 and the fastening protrusion portion 260 are aligned so that the first fastening hole 262 and the second fastening hole 302 communicate, the air guide 300 and the fastening protrusion portion 260 may be coupled by a fastening member 305 such as a screw. Here, the fastening member 305 may pass through the air guide 300 and the fastening protrusion portion 260 and fasten the air guide 300 to the fastening protrusion portion 260.

Also, the first cover protrusion 250 may further include a guide protrusion portion 270. The guide protrusion portion 270 may guide the position of the air guide 300 while in contact with the air guide 300 in the horizontal direction.

In the present embodiment, the guide protrusion portion 270 guides the position of the air guide 300 while in contact with the air guide 300 in the front-rear direction. The guide protrusion portion 270 may be formed to protrude in the vertical direction from an end of the fastening protrusion portion 260 that faces the air guide 300.

As an example, the guide protrusion portion 270 may be formed to protrude downward from a lower end of the fastening protrusion portion 260. Also, the guide protrusion portion 270 may be disposed at a rear side of the fastening protrusion portion 260. The guide protrusion portion 270 may be disposed to protrude downward from the rear side of the fastening protrusion portion 260 and may support the air guide 300 from a rear side.

The guide protrusion portion 270 may be disposed at the rear side of the fastening protrusion portion 260 and may be disposed at a position that satisfies the following condition.

That is, the guide protrusion portion 270 may be disposed at a position that allows the first fastening hole 262 and the second fastening hole 302 to be disposed in a straight line in the lateral/horizontal/forward-rearward direction when the rear end of the air guide 300 is in contact with the guide protrusion portion 270 in the front-rear direction.

According thereto, the position of the air guide 300 may be aligned relative to the first cover protrusion 250 so that the position of the first fastening hole 262 in the front-rear direction and the position of the second fastening hole 302 in the front-rear direction may coincide with each other when the rear end of the air guide 300 and the front end of the guide protrusion portion 270 are in contact.

Also, the guide protrusion portion 270 may support the air guide 300 from a rear side of the air guide 300 so that the air guide 300 is slidable in the lateral direction.

As an example, surfaces of the air guide 300 and the guide protrusion portion 270 that face each other, that is, the rear end of the air guide 300 and the front end of the guide protrusion portion 270, may form straight lines or planes parallel to each other.

Accordingly, the air guide 300 may move by sliding along the straight line or plane formed on the front end of the guide protrusion portion 270, and the guide protrusion portion 270 may guide a movement path of the air guide 300 in the lateral direction.

Also, in a state in which the rear end of the air guide 300 and the front end of the guide protrusion portion 270 are in contact, since the position of the air guide 300 is aligned so that the position of the first fastening hole 262 in the front-rear direction and the position of the second fastening hole 302 in the front-rear direction coincide with each other, the first fastening hole 262 of the fastening protrusion portion 260 may be disposed in a movement path of the second fastening hole 302 of the air guide 300 sliding in the lateral direction (see FIG. 13).

In the state in which the rear end of the air guide 300 and the front end of the guide protrusion portion 270 are in contact, when the air guide 300 is moved in the lateral direction so that the positions of the first fastening hole 262 and the second fastening hole 302 in the lateral direction coincide with each other, the position of the air guide 300 may be aligned to a position at which the first fastening hole 262 and the second fastening hole 302 are connected in the up-down direction (hereinafter referred to as "fastening position") (see FIG. 14).

That is, cover protrusions 250 and **250*a* of the present embodiment allow the installation position of the air guide 300 coupled to the fastening protrusion portion 260 to be guided by the guide protrusion portion 270 protruding from the rear side of the fastening protrusion portion 260**.

The cover protrusions 250 and **250*a* can provide advantageous effects that the air guide 300 is allowed to be installed at a set position with high accuracy and the installation of the air guide 300** is facilitated.

The installation position of the air guide 300 is guided by the guide protrusion portion 270 protruding from the rear side of the fastening protrusion portion 260 coupled to the air guide 300.

Meanwhile, the guide protrusion portion 270 may protrude a length that corresponds to the thickness of the air guide 300. According thereto, the guide protrusion portion 270 may not protrude to a lower side of the air guide 300. That is, when viewed from the front, only the air guide 300 disposed in front of the guide protrusion portion 270 is visible, and the guide protrusion portion 270 is covered by the air guide 300 and hardly visible.

In this case, since the lower end of the air guide 300 is able to be smoothly connected in a straight line in the horizontal direction, it is possible to make the front exterior of the air guide 300 look more stable and further enhance the aesthetics of the cooking appliance.

Further, the guide protrusion portion 270 may further include an extension cover portion 280. The extension cover portion 280 may be formed to protrude from the guide protrusion portion 270. The extension cover portion 280 may support the guide protrusion portion 270.

The extension cover portion 280 may be disposed at a rear of the guide protrusion portion 270. The extension cover portion 280 may be formed to protrude further in the lateral direction than the fastening protrusion portion 260 and the guide protrusion portion 270.

The extension cover portion 280 formed as described above may serve as a structure that supports the fastening protrusion portion 260 and the guide protrusion portion 270 and may improve the strength of the first cover protrusion 250.

Also, by covering a wider area than the fastening protrusion portion 260 and the guide protrusion portion 270, the extension cover portion may serve to more effectively cover the structures disposed at the rear side of the air guide 300.

Meanwhile, the cooking appliance of the present embodiment may further include a second cover protrusion **250*a*. A difference between the first cover protrusion 250 and the second cover protrusion 250***a* is that the second cover protrusion 250*a* does not include the extension cover portion 280. That is, the second cover protrusion 250*a* only includes the fastening protrusion portion 260 and the guide protrusion portion 270 and does not include the extension cover portion 280.

The first cover protrusion 250 and the second cover protrusion 250*a* may be integrally formed with the control panel 200. More specifically, the first cover protrusion 250 and the second cover protrusion 250*a* may be integrally formed with the lower end of the control panel 200.

In the present embodiment, the first cover protrusion 250, the second cover protrusion 250*a*, and the lower end of the control panel 200 are formed of a plastic material.

As an example, on the first cover protrusion 250, the fastening protrusion portion 260, the guide protrusion portion 270, and the extension cover portion 280 may be integrally formed. Here, on the first cover protrusion 250, the fastening protrusion portion 260, the guide protrusion portion 270, and the extension cover portion 280, which are made of a plastic material, may be integrally formed.

Also, on the second cover protrusion 250*a*, the fastening protrusion portion 260 and the guide protrusion portion 270 may be integrally formed. Here, on the second cover protrusion 250*a*, the fastening protrusion portion 260 and the guide protrusion portion 270, which are made of a plastic material, may be integrally formed.

Because the first cover protrusion 250 is made of a plastic material and integrally formed with the lower end of the control panel 200, not only is it possible to reduce costs required for adding the first cover protrusion 250, but also the weight of the first cover protrusion 250 can be significantly reduced compared to when the first cover protrusion 250 is formed of a metal material.

The air guide 300 may be formed of a metal material. As an example, the air guide 300 may be formed of a metal material having excellent thermal resistance and metallic luster. The air guide 300 is not easily deformed by high-temperature heat, is not easily damaged by impact, and can contribute to enhancing the aesthetics of the cooking appliance through its metallic luster.

In the present embodiment, the air guide 300 is formed of a metal material in consideration of the fact that the air guide 300 is disposed on a path along which high-temperature air is discharged, the fact that the air guide 300 is disposed at a visible position on the front surface of the cooking appliance, and the fact that the air guide 300 is disposed at a position where contact with a user may frequently occur.

[Air Guide Arrangement Structure in Consideration of Exterior of Front Surface of Cooking Appliance]

Referring to FIGS. 4 to 7, in a state in which (i.e. if) the air guide is excluded from the cooking appliance, various parts of the cooking appliance may be exposed to the front of the cooking appliance through the gap between the control panel 200 and the door 150 (hereinafter referred to as "front gap").

As an example, a portion of the first front panel 120 may be exposed to the front of the cooking appliance through the front gap. Specifically, the plurality of exhaust ports 122 provided in the control panel 200 may be exposed to the front of the cooking appliance through the front gap. Also, the partitions 121 disposed in between the exhaust ports 122 may also be exposed to the front of the cooking appliance through the front gap.

Among various electric components disposed in the electric component space 103, some of the electric components disposed at the rear of the exhaust ports 122 may be exposed to the front of the cooking appliance through the front gap.

When the above-listed components are exposed to the front of the cooking appliance, the components may adversely affect the front exterior of the cooking appliance. That is, the components formed on the first front panel 120, such as the exhaust ports 122 and the partitions 121, and the electric components exposed through the exhaust ports 122 may be factors that degrade the aesthetics of the front of the cooking appliance.

In order to reduce the influence of these components on the aesthetics of the front of the cooking appliance, in the present embodiment, the air guide 300 may be provided in the cooking appliance.

The air guide 300 may be disposed in the front gap. The air guide 300 is disposed between the control panel 200 and the door 150 and is provided to cover some of the first front panel 120, a latch 140, the electric components, and the like from the front thereof.

The air guide 300 covers a portion of the front gap between the control panel 200 and the door 150, and accordingly, some of the first front panel 120, the latch 140, the electric components, and the like exposed to the front of the cooking appliance through the front gap may be covered by the air guide 300.

The size of an area covered by the air guide 300 may increase with an increase in the thickness of the air guide 300. The increase in the size of the area covered by the air guide 300 may enhance the aesthetics of the front of the cooking appliance, but exhaustion of air to the front of the cooking appliance through the front space S (see FIG. 3) becomes difficult corresponding to the increase.

Conversely, the size of an area covered by the air guide 300 may decrease with a decrease in the thickness of the air guide 300. The decrease in the size of the area covered by the air guide 300 may degrade the aesthetics of the front of the cooking appliance, but exhaustion of air to the front of the cooking appliance through the front space S is further facilitated corresponding to the decrease.

In consideration of such aspects, the air guide 300 may be set to have the thickest possible thickness within a range in which the thickness facilitates exhaustion of air to the front of the cooking appliance through the front space S.

When the thickness of the air guide 300 is set to satisfy the above condition, the aesthetics of the front of the cooking appliance can be effectively enhanced while the efficiency of exhaustion of air through the front gap is maintained at a certain level or higher.

According to the present embodiment, because the area exposed to the front of the cooking appliance through the front gap is partially covered by the air guide 300, the aesthetics of the front of the cooking appliance can be enhanced.

As an example, the air guide 300 may be disposed in the front gap and may be disposed so that the first guide portion 310 may be positioned at the center of the front gap in the up-down direction. That is, the air guide 300 may be disposed between the control panel 200 and the door 150 closing the cooking chamber and may be disposed at a position where a distance between the first guide portion 310 and the control panel 200 in the up-down direction and a distance between the first guide portion 310 and the door 150 in the up-down direction are set to be equal (hereinafter referred to as "central position").

Accordingly, the air guide 300 may form a structure that allows the first guide portion 310 to cover the front gap at the center of the front gap in the up-down direction, that is, at the central position.

By allowing an upper area of the front gap and a lower area of the front gap to be symmetrical to each other about the first guide portion 310, the air guide 300 can make the front exterior of the cooking appliance look more stable and thus contribute to enhancing the aesthetics of the front of the cooking appliance.

The air guide 300 of the present embodiment can make the front exterior of the cooking appliance look more stable and effectively enhance the aesthetics of the front of the cooking appliance.

As another example, the air guide 300 may be disposed in the front gap and may be disposed at a position biased toward a lower portion from the center of the front gap in the up-down direction.

Considering that the eye level of the user is usually higher than the height at which the air guide 300 is disposed between the door 150 and the control panel 200, the air guide 300 may be disposed at the above-described position to allow the user to more easily identify the air guide 300.

Also, the air guide 300 may be disposed at the above-described position, where the air guide 300 can be easily seen from the outside of the cooking appliance, to more effectively convey an aesthetic sense provided by the air guide 300.

That is, by the air guide 300 being disposed at the position biased toward the lower portion from the center of the front gap in the up-down direction, the aesthetic sense can be effectively formed.

The air guide 300 may be coupled to the control panel 200 by the first cover protrusion 250 and the second cover protrusion 250*a*.

According to the present embodiment, a pair of first cover protrusions 250 may be disposed between the control panel 200 and the air guide 300. The pair of first cover protrusions 250 may be disposed to be symmetrical about the center of the cooking chamber in the lateral direction, that is, the center of the main body 100 in the lateral direction. Alternatively, it can be said that the pair of first cover protrusions 250 are disposed to be symmetrical about the center of the control panel 200 in the lateral direction.

The pair of first cover protrusions 250 may be disposed laterally outward from an area in which the exhaust port 122 is formed. At a rear side of the first cover protrusions 250 disposed in this way, the exhaust port 122 is not disposed, and only a vertical wall surface blocked by the first front panel 120 is disposed.

The first cover protrusion 250 includes the extension cover portion 280, and accordingly, the first cover protrusion 250 may cover a wider area than the second cover protrusion 250*a*. The area covered by the first cover protrusion 250 in this way is an area in which exhaustion of air through the exhaust port 122 does not occur.

Therefore, by increasing the size of an area covered by the air guide 300 while not degrading the exhaustion performance of the cooking appliance, the first cover protrusion 250 disposed in the above-described area may enhance the aesthetics of the front of the cooking appliance.

Also, the first cover protrusion 250 including the extension cover portion 280 may have a higher strength than the second cover protrusion 250*a* and may support the air guide 300 while in contact with the air guide 300 through a slightly wider area.

By supporting the air guide 300 from both sides of the air guide 300, the first cover protrusions 250 allow the air guide 300 of the present embodiment to be more stably fixed to the control panel 200.

The second cover protrusion 250*a* may be disposed at a position at which at least a portion of the second cover protrusion 250*a* can cover at least a portion of the partition 121 from a front side. For example, the second cover protrusion 250*a* may protrude downward from the lower end of the control panel 200 and may protrude from an upper side of the partition 121 in the vertical direction.

By the second cover protrusion 250*a* being disposed in this way, at least a portion of the partition 121 is covered. Accordingly, when viewed from the front, at least a portion of the partition 121 is covered by the second cover protrusion 250*a* and not visible.

The second cover protrusion 250*a* disposed as described above may be disposed between the pair of first cover protrusions 250. For example, among the plurality of cover protrusions 250 and 250*a* arranged in the lateral direction, the first cover protrusions 250 may be disposed at the outermost sides in the lateral direction, and the second cover protrusion 250*a* may be disposed therebetween.

By the second cover protrusion 250*a* and the first cover protrusions 250 being provided in this way, the air guide 300 may be coupled to the first cover protrusions 250 at a plurality of points in the lateral direction and may be stably fixed to the lower portion of the control panel 200.

That is, by increasing the number of coupling points between the control panel 200 and the air guide 300, the second cover protrusion 250*a* may contribute to stably fixing the air guide 300.

Also, the second cover protrusion 250*a* is disposed at a position at which the second cover protrusion 250*a* can cover the partition 121 from the front, and in this way, the second cover protrusion 250*a* prevents an increase in the number of vertical structures exposed through the front gap.

That is, the second cover protrusion 250*a* may be disposed so that the second cover protrusion 250*a* covers the partition 121, which is a vertical structure exposed through the front gap anyway. As a result, it may seem that the number of vertical structures exposed through the front gap has not been increased.

In this way, it is possible to effectively prevent degradation of the aesthetics of the front of the cooking appliance due to vertical structures exposed through the front gap.

Also, the second cover protrusion 250*a* disposed as described above may be disposed at a position avoiding the exhaust port 122. The exhaust port 122 forms a passage advantageous for air of the electric component space 103 (see FIG. 5) to be discharged to the front space S.

Air introduced into the electric component space 103 by the fan module 170 (see FIG. 5) may be heat-exchanged and cool the electric components in the electric component space 103. The air heat-exchanged in the electric component space 103 may be, while in a high-temperature state, discharged to the front space S through the exhaust port 122.

Under the assumption that the second cover protrusion 250*a* is formed of a plastic material, a risk of an occurrence of thermal deformation of the second cover protrusion 250*a* may increase when the second cover protrusion 250*a* is always exposed to high-temperature air discharged through the exhaust port 122.

For example, when the second cover protrusion 250*a* is disposed at the front of the exhaust port 122 instead of the front of the partition 121, thermal deformation of the second cover protrusion 250*a* may occur due to high-temperature air discharged through the exhaust port 122.

In consideration of this aspect, in the present embodiment, the second cover protrusion 250*a* is disposed at a position avoiding the exhaust port 122, that is, at the front of the partition 121 instead of the front of the exhaust port 122.

In this way, an occurrence of thermal deformation of the second cover protrusion 250*a* can be effectively prevented, and air can be smoothly discharged through the exhaust port 122 without being interfered by the second cover protrusion 250*a*.

That is, by being disposed at a position covering the exhaust port 122 from the front, the second cover protrusion 250*a* of the present embodiment may be disposed at a position at which the risk of an occurrence of thermal deformation of the second cover protrusion 250*a* is reduced while discharge of air through the exhaust port 122 is not interfered by the second cover protrusion 250*a* and may be disposed at a position at which the aesthetics of the front of the cooking appliance can be enhanced by the second cover protrusion 250*a*.

To sum up, the advantageous effects provided by the air guide 300 disposed as described above and the cover protrusions 250 and 250*a* for fixing the air guide 300 are as follows.

First, because structures exposed through the front gap are partially covered by the air guide 300 providing a structure that crosses the front gap in the lateral direction and covers the front gap, the aesthetics of the front of the cooking appliance can be enhanced.

By causing a line of sight toward the front gap to be focused on the air guide 300 while partially covering other structures at the rear, the air guide 300 provides an optical illusion effect that makes it seem like only the air guide 300 is present in the front gap.

Also, by forming a structure that covers the front gap at the central position of the front gap, the air guide 300 allows the upper area of the front gap and the lower area of the front gap to be symmetrical to each other and makes the front exterior of the cooking appliance look more stable.

In this way, the air guide 300 can contribute to effectively enhancing the aesthetics of the front of the cooking appliance.

Second, by the second cover protrusion 250*a* being disposed at a position at which the second cover protrusion 250*a* covers the partition 121, configured to isolate one exhaust port 122 and another exhaust port 122 from each other, from the front, it is possible to simultaneously provide an advantageous effect that a risk of an occurrence of thermal deformation of the second cover protrusion 250*a* is reduced without interfering with the discharge of air through the exhaust port 122 and an advantageous effect that the aesthetics of the front of the cooking appliance are enhanced.

[Air Guide Arrangement Structure in Consideration of Exhaust Flow]

Referring to FIGS. 4 to 5, by the operation of the fan module 170, outside air may be introduced into the electric component space 103 from a rear side of the cooking appliance. Air introduced into the electric component space 103 in this way may move forward inside the electric component space 103 and cool the electric components inside the electric component space 103.

More specifically, outside air may be introduced into the cooking appliance through a lower portion of the main body 100. Outside air introduced through the lower portion of the main body 100 may, while passing through a rear space of the cooking appliance where the convection portion 160 or the like is disposed, cool various components disposed in the rear space of the cooking appliance, for example, a motor for driving the convection portion 160.

Air moving upward after passing through the rear space of the cooking appliance as described above may be suctioned by the fan module 170 and move toward the electric component space 103. The air introduced into the the electric component space 103 may move forward inside the the component space 103 and cool the electric components inside the electric component space 103.

Air moving forward inside the electric component space 103 as described above may be discharged to the front of the electric component space 103, that is, the front space S, through the exhaust port 122.

Also, air inside the door 150 that is heated by heat transferred from the cooking chamber 101 during a cooking process may be discharged to the outside of the door 150 through the door exhaust port 152 provided in the upper end of the door 150.

As hot air inside the door 150 is discharged, outside air present at a lower side of the front of the cooking appliance may be introduced into the door 150 through an air flow hole provided in the lower portion of the door 150 and move upward. In this process, the door 150 heated by the heat transferred from the cooking chamber 101 to the door 150 may be cooled.

Also, air moving upward inside the door 150 while cooling the door 150 may be discharged to the front space S through the door exhaust port 152. That is, air discharged through the exhaust port 122 and air discharged through the door exhaust port 152 may be mixed in the front space S and discharged to the front of the cooking appliance.

According to the present embodiment, the front space S is a space surrounded by the door 150, the first front panel 120, and the control panel 200, and the air guide 300 may be disposed in the front space S.

The exhaust port 122 may communicate with the front space S at a rear side of the front space S, and the door exhaust port 152 may communicate with the front space S at a lower side of the front space S. Also, the front space S may be open toward the front of the cooking appliance.

The door exhaust port 152 may be disposed between the air guide 300 and the first front panel 120. Specifically, the door exhaust port 152 may be disposed at a front of the exhaust port 122. That is, in the front-rear direction, the door exhaust port 152 may be disposed between the air guide 300 and the exhaust port 122.

Also, the door exhaust port 152 may be disposed at a lower side of the air guide 300 and the exhaust port 122. Further, the door exhaust port 152 may be provided in the upper end of the door 150 and provided on the second half portion 150*b*.

Accordingly, the door exhaust port 152 may be disposed at a position biased toward the rear on the door 150 and may be disposed at a side that is lower than the uppermost end of the door 150 formed by the first half portion 150*a*.

Looking at the arrangement relationship of the exhaust port 122, the door exhaust port 152, and the air guide 300, the door exhaust port 152 is disposed at a position at which the door exhaust port 152 can be as adjacent as possible to the exhaust port 122 in the front-rear direction on the door 150.

When the door exhaust port 152 is disposed on the first half portion 150*a* of the door 150 instead of the second half portion 150*b* of the door 150, the possibility that hot air discharged through the exhaust port 122 may flow backward into the door 150 through the door exhaust port 152 is increased.

Air discharged through the exhaust port 122 gradually diffuses in the front space S and moves from the front space S to the front of the cooking appliance. That is, air discharged through the exhaust port 122 moves forward while being diffused in the up-down direction as well as the left-right direction in the front space S.

Therefore, the more the door exhaust port 152 is disposed towards the front side in the front space S, the higher the possibility that air discharged through the exhaust port 122 may be introduced into the door exhaust port 152. When hot air discharged through the exhaust port 122 flows backward into the door 150 through the door exhaust port 152 in this way, the door 150 cannot be cooled smoothly, and it is difficult for heat introduced into the front space S to be smoothly discharged to the outside of the cooking appliance.

In consideration of such aspects, in the present embodiment, the door exhaust port 152 is disposed on the second half portion 150*b* of the door 150, and thus, the door exhaust port 152 may be disposed at a position at which the door exhaust port 152 may be as adjacent as possible to the exhaust port 122 in the front-rear direction on the door 150.

As a result, the door exhaust port 152 may be disposed at a position at which the door exhaust port 152 can deviate as much as possible from a flow area of air discharged through the exhaust port 122, among positions in the front-rear direction selectable within the door 150.

Also, according to the present embodiment, by being disposed on the second half portion 150*b*, the door exhaust port 152 may be disposed at a side that is lower than the uppermost end of the door 150 formed by the first half portion 150*a*. That is, the door exhaust port 152 may be disposed at a position further downward from the flow area of air discharged through the exhaust port 122.

As a result, the door exhaust port 152 may be disposed at a position at which the door exhaust port 152 can deviate as much as possible from the flow area of air discharged through the exhaust port 122. The door exhaust port 152 disposed in this way may contribute to effectively suppressing an occurrence of a phenomenon in which hot air discharged to the front space S flows backward into the door 150.

Also, the door exhaust port 152 may be disposed more toward the rear than the air guide 300 instead of being disposed at a lower side of the air guide 300 in the vertical direction. Accordingly, air discharged from the door exhaust port 152 can smoothly flow toward the front space S without being interfered by the air guide 300.

According to the present embodiment, the door exhaust port 152 may be disposed between the air guide 300 and the first front panel 120. That is, the air guide 300 may be disposed at a front of the exhaust port 122 and the door exhaust port 152. The air guide 300 may be disposed at a position biased toward the front side in the front space S.

The air guide 300 disposed in this way may, at the front side of the front space S, guide a flow of air discharged from the exhaust port 122 and the door exhaust port 152 toward the front space S.

For example, air discharged from the exhaust port 122 toward the front space S and air discharged from the door exhaust port 152 toward the front space S may be mixed in the front space S and discharged to the front of the cooking appliance. The air guide 300 may be disposed on a flow path of air discharged from the front space S to the front of the cooking appliance in this way (hereinafter referred to as "exhaust flow path").

The air guide 300 disposed in this way may be provided in the shape of a frame in which the width is longer than the length and the thickness, and the thickness is smaller than the length and the width.

The air guide 300 of the present embodiment can not only effectively suppress an increase in the temperature of the door 150 due to hot air discharged to the front of the cooking chamber but also effectively suppress air discharged from inside the electric component space or the door 150 from flowing backward into the door 150.

Meanwhile, as illustrated in FIGS. 6 and 7, the second cover protrusion 250*a* fixing the air guide 300 to the control panel 200 may be disposed between one exhaust port 122 and another exhaust port 122.

The second cover protrusion 250*a* is disposed at a front of the partition 121 to cover the partition 121 and make the partition 121 not visible and is disposed at a position not overlapping with the exhaust port 122 to effectively lower the flow resistance generated due to the first cover protrusion 250 or the air guide 300.

Further, a front end 301 of the air guide 300 that is disposed at a front side of the front space S in the front space S as described above, that is, the front end 301 of the first guide portion 310, may be disposed at a position overlapping with at least a portion of the front glass 153 of the door 150 in the up-down direction.

As an example, the front end 301 of the air guide 300 may be, in the front-rear direction, disposed at the same position as a rear end of the front glass 153 or disposed at a position protruding more toward the front than the rear end of the front glass 153.

By the air guide 300 being disposed at a position biased toward the front in the front space S as described above, a flow of air from the front space S toward the front of the cooking appliance can be more effectively guided by the air guide 300.

Also, by the air guide 300 being disposed at a position where the air guide 300 can be easily seen from the outside of the cooking appliance, an aesthetic sense provided by the air guide 300 can be more effectively conveyed.

Meanwhile, during the process in which hot air is discharged from the front space S, some of the discharged air may come in contact with the lower end of the control panel 200 and cause condensate to be formed on the lower end of the control panel 200.

When the condensate formed on the lower end of the control panel 200 in this way drops to the upper end of the door 150, water colliding with the door 150 splashes around the door 150 and contaminates the surroundings of the door 150.

When the air guide 300 is disposed at the position biased toward the front in the front space S as described above, the air guide 300 may block the gap between the control panel 200 and the door 150 to prevent the condensate formed on the lower end of the control panel 200 from dropping to the door 150.

Because a distance between the control panel 200 and the air guide 300 is much closer than a distance between the control panel 200 and the door 150, even when the condensate drops to the air guide 300, the amount of water splashing around the air guide 300 is not that large.

That is, the air guide 300 disposed as described above can significantly reduce the occurrence of contamination of the surroundings of the cooking appliance due to the condensate.

Further, a rear end of the air guide 300, may be disposed more toward the front than the door exhaust port 152 in the front-rear direction.

Accordingly, a passage having a sufficient height that allows air inside the door 150 to be discharged to the front space S through the door exhaust port 152 can be formed between the door exhaust port 152 and the air guide 300.

As a result, air discharged from the door exhaust port 152 and air discharged from the exhaust port 122 may pass through a section where the air guide 300 is disposed after being sufficiently mixed with each other in the front space S.

Also, when the rear end of the air guide 300 is disposed at the above-described position, the air guide 300 is not an obstacle disposed at an upper portion of the door exhaust port 152 in the vertical direction. Due to the air guide 300, the flow resistance around the door exhaust port 152 can be effectively reduced.

As another example, the front end of the air guide 300 may be disposed at a position coinciding with at least any one of a front-side end of the control panel 200 and a front-side end of the door 150 in the front-rear direction.

For example, when viewed from a side, the front end of the air guide 300 and a front-side lower end corner of the control panel 200 may be disposed to be collinear. Also, when viewed from the side, the front end 301 of the air guide 300 and a front-side upper end corner of the door 150 may be disposed to be collinear.

By the air guide 300 being disposed as described above, the positions of the control panel 200, the air guide 300, and the door 150 are aligned, and the exterior of the cooking appliance may seem more balanced, and thus the aesthetics of the cooking appliance can be further enhanced.

In this way, the air guide 300 is disposed to be biased toward the front side of the front space S in the front space S in order to enhance the aesthetics of the cooking appliance.

That is, by being disposed to be biased toward the front side of the front space S in the front space S, the air guide 300 of the present embodiment can simultaneously provide an effect of suppressing the generation of a vortex in the front space S and an effect of enhancing the aesthetics of the cooking appliance.

An object of the present technique is to provide a cooking appliance with an improved structure to suppress air discharged from an electric component chamber from flowing backward into a door.

Another object of the present technique is to provide a cooking appliance with an improved structure to allow an air guide to be installed at a set position with high accuracy and facilitate the installation of the air guide.

Yet another object of the present technique is to provide a cooking appliance with an improved structure to reduce a risk of contact between a user and a hot component when the user opens the door.

Yet another object of the present technique is to provide a cooking appliance with an improved structure to reduce an influence of high-temperature air discharged from the cooking appliance and enhance aesthetics of the cooking appliance.

One or more objects of the present technique are achieved by the invention set out by the subject-matter of the independent claim(s).

A cooking appliance, of the present technique, includes an air guide provided/advantageously therein.

A cooking appliance, of the present technique, may include a cover protrusion coupled to an air guide to fix the air guide to a gap between a door and a control panel, and a position at which the air guide is coupled to the cover protrusion is guided by a guide protrusion portion provided at the cover protrusion.

Also, in another embodiment of the present disclosure, a cooking appliance may include an air guide configured to cover at least a portion of a front panel from a front side and a cover protrusion coupled to the air guide while in contact with the air guide in a vertical direction, and the cover protrusion may include a guide protrusion portion configured to guide the position of the air guide while in contact with the air guide in a horizontal direction.

Also, in another embodiment of the present disclosure, an air guide may be disposed in a gap between a door and a control panel, and the air guide may cover at least a portion of a front panel from a front side.

In this way, according to the present disclosure, by covering a certain portion of the gap between the door and the control panel, the aesthetics of the front of the cooking appliance can be enhanced.

Also, in another embodiment of the present disclosure, a front space surrounded by a control panel and a door may be formed between the control panel and the door, and an air guide disposed in the front space may be exposed to the front of the cooking appliance through a gap between the door and the control panel.

Also, in another embodiment of the present disclosure, an air guide may be disposed in a gap between a door and a control panel, and the air guide may cover at least a portion of a structure disposed at the same height as the gap between the door and the control panel from a front side.

Also, in another embodiment of the present disclosure, a cover protrusion provided to fix an air guide to a control panel may be disposed to cover a partition configured to isolate one exhaust port and another exhaust port from each other.

In this way, it is possible to provide advantageous effects that an influence of high-temperature air discharged from the cooking appliance is reduced, and the aesthetics of the cooking appliance are enhanced.

One aspect of the present disclosure provides a cooking appliance including: a cavity having a cooking chamber with an open front side formed therein; a door disposed at a front of the cavity to open and close the cooking chamber; a control panel disposed at a portion above the cavity and the door; an air guide configured to cover at least a portion of a front panel from a front side and disposed between the door and the control panel; and a cover protrusion configured to protrude from the door or the control panel toward the air guide.

Also, the air guide may be coupled to the cover protrusion.

Also, the cover protrusion may include a fastening protrusion portion coupled to the air guide while in contact with the air guide in a vertical direction and a guide protrusion portion configured to guide the position of the air guide while in contact with the air guide in a horizontal direction.

In the present disclosure, the fastening protrusion portion may also be referred to as fastening portion, and the guide protrusion portion may be referred to as guiding portion.

Also, the guide protrusion portion may be formed to protrude in the vertical direction from an end of the fastening protrusion portion that faces the air guide.

Also, the guide protrusion portion may be disposed at a rear side of the fastening protrusion portion to support the air guide from a rear side.

Also, the guide protrusion portion may protrude a length that corresponds to a thickness of the air guide.

Also, a fastening hole may be formed in each of the air guide and the fastening protrusion portion to pass therethrough in the vertical direction, and the guide protrusion portion may be disposed at the rear side of the fastening protrusion portion.

Also, when the air guide is in contact with the guide protrusion portion in a front-rear direction, the fastening hole formed in the air guide and the fastening hole formed in the fastening protrusion portion may be disposed in a straight line in a lateral direction.

Also, the guide protrusion portion may support the air guide from a rear side of the air guide so that the air guide is slidable in the lateral direction.

Also, the fastening hole of the fastening protrusion portion may be disposed in a movement path of the fastening hole of the air guide sliding in the lateral direction.

Also, the cover protrusion may be provided as a plurality of cover protrusions disposed in the lateral direction.

Also, an extension cover portion configured to protrude from the guide protrusion portion and support the guide protrusion portion may be provided on at least any one of the plurality of cover protrusions.

Also, the guide protrusion portion may be disposed at a rear side of the fastening protrusion portion to support the air guide from a rear side.

Also, the extension cover portion may be disposed at a rear of the guide protrusion portion and may be formed to protrude further in the lateral direction than the fastening protrusion portion and the guide protrusion portion.

Also, the fastening protrusion portion, the guide protrusion portion, and the extension cover portion may be integrally formed.

Also, a plurality of exhaust ports may be disposed to be spaced apart at predetermined intervals in the lateral direction in the front panel, a partition may be formed between two adjacent exhaust ports, and the cover protrusion may be disposed at a front side of each partition to cover the partition from the front side.

Also, the cover protrusion may be provided at the control panel.

Also, the air guide may be coupled to the cover protrusion and fixed to the control panel.

At least a portion of the control panel may be integrally formed with the fastening protrusion portion and the guide protrusion portion.

According to a cooking appliance of the present disclosure, a door exhaust port may be disposed at a position at which the door exhaust port can deviate as much as possible from a flow area of air discharged through an exhaust port, and an air guide may be disposed on an exhaust flow path and diverge a flow of air flowing through the exhaust flow path.

In this way, according to the present disclosure, not only is it possible to effectively suppress hot air discharged to a front space from flowing backward into a door, but also generation of a vortex can be effectively suppressed.

Also, according to the present disclosure, since an installation position of an air guide coupled to a fastening protrusion portion is guided by a guide protrusion portion that protrudes to a rear side of the fastening protrusion portion, it is possible to provide advantageous effects that the air guide is allowed to be installed at a set position with high accuracy and the installation of the air guide is facilitated.

Also, an air guide of the present disclosure is fixed to a control panel instead of a door and is provided to not move forward together with the door when the door is opened.

The cooking appliance of the present disclosure that includes the air guide reduces the possibility of contact between a user and the air guide that may be in a high-temperature state due to coming in contact with a hot discharge flow, and in this way, a risk that the user may get burned due to coming in contact with a high-temperature component when opening the door can be effectively reduced.

Also, according to the present disclosure, structures exposed through a front gap are partially covered by an air guide providing a structure that crosses the front gap in a lateral direction and covers the front gap, and in this way, the aesthetics of the front of the cooking appliance can be enhanced.

Also, according to the present disclosure, a line of sight toward the front gap of the cooking appliance is focused on the air guide, thereby providing an optical illusion effect that makes it seem like only the air guide is present in the front gap, and in this way, the aesthetics of the front of the cooking appliance can be more effectively enhanced.

Also, according to the present disclosure, a front surface of the air guide is disposed at a central position of the front gap so that an upper area of the front gap and a lower area of the front gap are symmetrical to each other, and in this way, it is possible to make the front exterior of the cooking appliance look more stable and further enhance the aesthetics of the cooking appliance.

Also, according to the present disclosure, a second cover protrusion is disposed at a position at which the second cover protrusion covers a partition, configured to isolate one exhaust port and another exhaust port from each other, from a front, and in this way, it is possible to simultaneously provide an advantageous effect that a risk of an occurrence of thermal deformation of the cover protrusion is reduced without interfering with the discharge of air through the exhaust ports and an advantageous effect that the aesthetics of the front of the cooking appliance are enhanced.

According to the present disclosure, since an air guide formed of a metal material with excellent thermal resistance is provided, the air guide disposed on a path along which high-temperature air is discharged can be prevented from being easily deformed by heat and easily damaged by impact, and the aesthetics of the cooking appliance can be enhanced through metallic luster provided by the air guide.

The present disclosure has been described above with reference to the embodiments illustrated in the accompanying drawings, but the above description is merely illustrative, and those of ordinary skill in the art should understand that various modifications and other equivalent embodiments are possible from the above description. Therefore, the true technical scope of the present disclosure should be defined by the claims below.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking appliance, comprising:

cavity walls having a cooking chamber with an open front side;

a door provided at a front of the cavity walls to open and close the cooking chamber;

a control panel provided above the cavity and the door;

an air guide provided between the door and the control panel; and a cover protrusion provided at the control panel and protruding from the control panel, wherein:

the air guide is coupled to the cover protrusion and is fixed to the control panel, and the cover protrusion guides a position of the air guide and is in contact with the air guide in a horizontal direction.

2. The cooking appliance of claim 1, wherein:

the cooking appliance comprises a plurality of the cover protrusions, and the plurality of the cover protrusions are in a lateral direction; and the cooking appliance further comprises an extension cover protrusion that protrudes from at least one of the plurality of cover protrusions and is configured to support the cover protrusions.

3. The cooking appliance of claim 2, wherein:

at least one of the plurality of cover protrusions includes a guide protrusion region configured to guide the position of the air guide and to be in contact with the air guide in the horizontal direction; and the extension cover protrusion protrudes from the guide protrusion region and supports the guide protrusion region.

4. The cooking appliance of claim 2, wherein:

at least one of the plurality of cover protrusions includes a fastening protrusion region coupled to the air guide and in contact with the air guide in the vertical direction;

the guide protrusion region is provided at a rear side of the fastening protrusion region to support the air guide from a rear side; and the extension cover protrusion is provided at a rear of the guide protrusion region and is formed to protrude further in the lateral direction than the fastening protrusion region and the guide protrusion region.

5. The cooking appliance of claim 4, wherein:

at least one of the plurality of cover protrusions includes a fastening protrusion region coupled to the air guide and in contact with the air guide in the vertical direction; and the fastening protrusion region, the guide protrusion region, and the extension cover protrusion are integrally formed.

6. The cooking appliance of claim 1, wherein:

the air guide is configured to cover at least a portion of a front of a front panel;

the cooking appliance comprises:

a plurality of exhaust ports that are provided on the front panel and are spaced apart in a lateral direction in the front panel;

a partition that is formed between an adjacent pair of the plurality of exhaust ports; and the cover protrusion is provided at a front side of the partition to cover the front side of the partition.

7. The cooking appliance of claim 1, wherein:

the cover protrusion includes a fastening protrusion region coupled to the air guide and in contact with the air guide in a vertical direction, and a guide protrusion region configured to guide the position of the air guide and in contact with the air guide in the horizontal direction; and at least a portion of the control panel is integrally formed with the fastening protrusion region and the guide protrusion region.

8. The cooking appliance of claim 1, wherein the cover protrusion includes:

a fastening protrusion region coupled to the air guide and in contact with the air guide in a vertical direction; and a guide protrusion region configured to guide the position of the air guide and in contact with the air guide in the horizontal direction.

9. The cooking appliance of claim 8, wherein the guide protrusion region is provided at a rear side of the fastening protrusion region to support the air guide from a rear side.

10. The cooking appliance of claim 9, wherein the guide protrusion region protrudes in the vertical direction from an end of the fastening protrusion region that faces the air guide.

11. The cooking appliance of claim 9, wherein the guide protrusion region protrudes by a length that corresponds to a thickness of the air guide.

12. The cooking appliance of claim 8, wherein:

each of the air guide and the fastening protrusion region includes a fastening hole that extends in the vertical direction;

the guide protrusion region is provided at the rear side of the fastening protrusion region; and the air guide contacts the guide protrusion region in a front-rear direction such that the fastening hole formed in the air guide and the fastening hole formed in the fastening protrusion region are provided in a straight line in a lateral direction to receive a fastener, the fastener passes through the fastening hole of the air guide and the fastening hole of the fastening protrusion region to fasten the air guide to the fastening protrusion region.

13. The cooking appliance of claim 12, wherein:

the guide protrusion region supports the air guide from a rear side of the air guide so that the air guide is slidable in the lateral direction; and the fastening hole of the fastening protrusion region is provided in a movement path of the fastening hole of the air guide sliding in the lateral direction.

14. A cooking appliance, comprising:

a main body defining a cooking chamber and having a front panel with an opening to access the cooking chamber;

a door hingedly connected to the main body to open and close the opening of the front panel;

a control panel provided above the door;

a cover protrusion provided at the control panel; and an air guide coupled to the cover protrusion and fixed to the control panel and provided in space between the door and the control panel and in front of the front panel.

15. The cooking appliance of claim 14, wherein the cover protrusion includes:

a fastening protrusion region coupled to the air guide and to be contact with the air guide in a vertical direction; and a guide protrusion region configured to guide the position of the air guide and to be in contact with the air guide in a horizontal direction.

16. The cooking appliance of claim 15, wherein the guide protrusion region is provided at a rear side of the fastening protrusion region to support the air guide from a rear side.

17. The cooking appliance of claim 15, wherein the guide protrusion region protrudes in the vertical direction from an end of the fastening protrusion region that faces the air guide.

18. The cooking appliance of claim 14, wherein:

the cooking appliance comprises a plurality of exhaust ports that are provided on the front panel and are spaced apart in a lateral direction; and the cover protrusion is positioned between an adjacent pair of the exhaust ports so as to not block the exhaust ports.

* * * * *